US008267745B2

(12) United States Patent
Bhagavat et al.

(10) Patent No.: US 8,267,745 B2
(45) Date of Patent: Sep. 18, 2012

(54) METHODS OF GRINDING SEMICONDUCTOR WAFERS HAVING IMPROVED NANOTOPOLOGY

(75) Inventors: Milind S. Bhagavat, Fremont, CA (US); Puneet Gupta, Houston, TX (US); Roland R. Vandamme, Wentzville, MO (US); Takuto Kazama, Tochigi Prefecture (JP); Noriyuki Tachi, Tokyo (JP)

(73) Assignee: MEMC Electronic Materials, Inc., St. Peters, MO (US)

( * ) Notice: Subject to any disclaimer, the term of this patent is extended or adjusted under 35 U.S.C. 154(b) by 0 days.

(21) Appl. No.: 12/899,262

(22) Filed: Oct. 6, 2010

(65) Prior Publication Data

US 2011/0101504 A1 May 5, 2011

Related U.S. Application Data

(62) Division of application No. 10/598,851, filed as application No. PCT/US2005/001732 on Jan. 20, 2005, now Pat. No. 8,066,553.

(60) Provisional application No. 60/554,684, filed on Mar. 19, 2004.

(51) Int. Cl.
*B24B 1/00* (2006.01)

(52) U.S. Cl. ..... 451/41; 451/63; 451/261; 451/267; 451/364

(58) Field of Classification Search ..... 451/5, 41, 451/63, 261, 262, 267, 268, 269, 282, 364, 451/365

See application file for complete search history.

(56) References Cited

U.S. PATENT DOCUMENTS

| | | | | |
|---|---|---|---|---|
| 2,448,751 | A | 9/1948 | Volkel | |
| 6,062,959 | A * | 5/2000 | Weldon et al. | 451/307 |
| 6,086,456 | A | 7/2000 | Weldon et al. | |
| 7,601,049 | B2 | 10/2009 | Bhagavat et al. | |
| 7,662,023 | B2 | 2/2010 | Vandamme et al. | |
| 7,867,059 | B2 * | 1/2011 | Pietsch et al. | 451/11 |
| 2002/0185053 | A1 | 12/2002 | Fei et al. | |
| 2003/0017787 | A1 | 1/2003 | Weldon et al. | |
| 2005/0173377 | A1 * | 8/2005 | Pietsch et al. | 216/88 |
| 2008/0166948 | A1 | 7/2008 | Bhagavat et al. | |

(Continued)

FOREIGN PATENT DOCUMENTS

EP 1118429 A1 7/2001

(Continued)

OTHER PUBLICATIONS

Written Report mailed Feb. 18, 2011 regarding EP05711676.6; 4 pages.

(Continued)

*Primary Examiner* — Eileen P. Morgan
(74) *Attorney, Agent, or Firm* — Armstrong Teasdale LLP

(57) ABSTRACT

Methods for holding a workpiece with a hydrostatic pad are disclosed herein. The pad includes hydrostatic pockets formed in a face of the body directly opposed to the wafer. The pockets are adapted for receiving fluid through the body and into the pockets to provide a barrier between the body face and the workpiece while still applying pressure to hold the workpiece during grinding. The hydrostatic pads allow the wafer to rotate relative to the pads about their common axis. The pockets are oriented to reduce hydrostatic bending moments that are produced in the wafer when the grinding wheels shift or tilt relative to the hydrostatic pads, helping prevent nanotopology degradation of surfaces of the wafer commonly caused by shift and tilt of the grinding wheels.

10 Claims, 21 Drawing Sheets

U.S. PATENT DOCUMENTS

| | | | | |
|---|---|---|---|---|
| 2009/0203297 | A1* | 8/2009 | Pietsch et al. | 451/57 |
| 2010/0087123 | A1 | 4/2010 | Vandamme et al. | |

FOREIGN PATENT DOCUMENTS

| | | | |
|---|---|---|---|
| JP | 11221747 | A | 8/1999 |
| JP | 2000280155 | | 10/2000 |
| JP | 2003124167 | A | 4/2003 |
| WO | 0211947 | A2 | 2/2002 |

OTHER PUBLICATIONS

International Search Report for WO 2005/095054, 3 pages.

Search report for analogous Taiwanese Application No. 094103075 issued May 27, 2007, 1 page.

Japanese Communication Second Office Action for Application No. 2007-503897 dated Sep. 20, 2011; 2 pages.

* cited by examiner

METHODS OF GRINDING SEMICONDUCTOR WAFERS HAVING IMPROVED NANOTOPOLOGY

CROSS-REFERENCE TO RELATED APPLICATIONS

The present application is a divisional of co-pending U.S. patent application Ser. No. 10/598,851, filed May 10, 2007, which claims the benefit of International (PCT) Application Serial No. PCT/US2005/001732, filed Jan. 20, 2005. The PCT application claims priority from U.S. Provisional Patent Application Ser. No. 60/554,684, filed Mar. 19, 2004. The entire disclosures of these applications are incorporated herein by reference.

BACKGROUND OF THE INVENTION

This invention relates generally to simultaneous double side grinding of semiconductor wafers and more particularly to methods for using a wafer-clamping device of a double side grinder.

Semiconductor wafers are commonly used in the production of integrated circuit chips on which circuitry is printed. The circuitry is first printed in miniaturized form onto surfaces of the wafers, then the wafers are broken into circuit chips. But this smaller circuitry requires that wafer surfaces be extremely flat and parallel to ensure that the circuitry can be properly printed over the entire surface of the wafer. To accomplish this, a grinding process is commonly used to improve certain features of the wafers (e.g., flatness and parallelism) after they are cut from an ingot.

Simultaneous double side grinding operates on both sides of the wafer at the same time and produces wafers with highly planarized surfaces. It is therefore a desirable grinding process. Double side grinders that can be used to accomplish this include those manufactured by Koyo Machine Industries Co., Ltd. These grinders use a wafer-clamping device to hold the semiconductor wafer during grinding. The clamping device typically comprises a pair of hydrostatic pads and a pair of grinding wheels. The pads and wheels are oriented in opposed relation to hold the wafer therebetween in a vertical orientation. The hydrostatic pads beneficially produce a fluid barrier between the respective pad and wafer surface for holding the wafer without the rigid pads physically contacting the wafer during grinding. This reduces damage to the wafer that may be caused by physical clamping and allows the wafer to move (rotate) tangentially relative to the pad surfaces with less friction. While this grinding process significantly improves flatness and parallelism of the ground wafer surfaces, it can also cause degradation of the topology of the wafer surfaces.

In order to identify and address the topology degradation concerns, device and semiconductor material manufacturers consider the nanotopology of the wafer surfaces. Nanotopology has been defined as the deviation of a wafer surface within a spatial wavelength of about 0.2 mm to about 20 mm. This spatial wavelength corresponds very closely to surface features on the nanometer scale for processed semiconductor wafers. The foregoing definition has been proposed by Semiconductor Equipment and Materials International (SEMI), a global trade association for the semiconductor industry (SEMI document 3089). Nanotopology measures the elevational deviations of one surface of the wafer and does not consider thickness variations of the wafer, as with traditional flatness measurements. Several metrology methods have been developed to detect and record these kinds of surface variations. For instance, the measurement deviation of reflected light from incidence light allows detection of very small surface variations. These methods are used to measure peak to valley (PV) variations within the wavelength.

A typical wafer-clamping device 1' of a double side grinder of the prior art is schematically shown in FIGS. 1 and 2. Grinding wheels 9' and hydrostatic pads 11' hold the wafer W independently of one another. They respectively define clamping planes 71' and 73'. A clamping pressure of the grinding wheels 9' on the wafer W is centered at a rotational axis 67' of the wheels, while a clamping pressure of the hydrostatic pads 11' on the wafer is centered near a center WC of the wafer. As long as clamping planes 71' and 73' are held coincident during grinding (FIG. 1), the wafer remains in plane (i.e., does not bend) and is uniformly ground by wheels 9'. A general discussion regarding alignment of clamping planes may be found in published European Appl. No. 1,118,429. However, if the two planes 71' and 73' become misaligned, the clamping pressures of the grinding wheels 9' and hydrostatic pads 11' produce a bending moment, or hydrostatic clamping moment, in the wafer W that causes the wafer to bend sharply generally adjacent peripheral edges 41' of the grinding wheel openings 39' (FIG. 2). This produces regions of high localized stress in the wafer W.

Misalignment of clamping planes 71' and 73' is common during double side grinding operation and is generally caused by movement of the grinding wheels 9' relative to the hydrostatic pads 11' (FIG. 2). Possible modes of misalignment are schematically illustrated in FIGS. 2 and 3. These include a combination of three distinct modes. In the first mode there is a lateral shift S of the grinding wheels 9' relative to the hydrostatic pads 11' in translation along an axis of rotation 67' of the grinding wheels (FIG. 2). A second mode is characterized by a vertical tilt VT of the wheels 9' about a horizontal axis X through the center of the respective grinding wheel (FIGS. 2 and 3). FIG. 2 illustrates a combination of the first mode and second mode. In a third mode there is a horizontal tilt HT of the wheels 9' about a vertical axis Y through the center of the respective grinding wheel (FIG. 3). These modes are greatly exaggerated in the drawings to illustrate the concept; actual misalignment may be relatively small. In addition, each of the wheels 9' is capable of moving independently of the other so that horizontal tilt HT of the left wheel can be different from that of the right wheel, and the same is true for the vertical tilts VT of the two wheels.

The magnitude of hydrostatic clamping moments caused by misalignment of clamping planes 71' and 73' is related to the design of the hydrostatic pads 11'. For example, higher moments are generally caused by pads 11' that clamp a larger area of the wafer W (e.g., pads that have a large working surface area), by pads in which a center of pad clamping is located a relatively large distance apart from the grinding wheel rotational axis 67', by pads that exert a high hydrostatic pad clamping force on the wafer (i.e., hold the wafer very rigidly), or by pads that exhibit a combination of these features.

In clamping device 1' using prior art pads 11' (an example of one prior art pad is shown in FIG. 4), the bending moment in wafer W is relatively large when clamping planes 71' and 73' misalign because the wafer is clamped very tightly and rigidly by the pads 11', including near peripheral edges 41' of grinding wheel opening 39'. The wafer cannot adjust to movement of grinding wheels 9' and the wafer bends sharply near opening edges 41' (FIG. 2). The wafers W are not uniformly ground and they develop undesirable nanotopology features that cannot be removed by subsequent processing (e.g., polishing). Misalignment of clamping planes 71' and 73' can also cause the grinding wheels 9' to wear unevenly, which can further contribute to development of undesirable nanotopology features on the ground wafer W.

FIGS. 5A and 5B illustrate undesirable nanotopology features that can form on surfaces of a ground wafer W when clamping planes 71' and 73' misalign and the wafer bends during the grinding operation. The features include center-marks 77' and B-rings 79' (FIG. 5A). The center-marks 77' are generally caused by a combination of lateral shift S and vertical tilt VT of the grinding wheels 9', while the B-rings 79' are generally caused by a combination of lateral shift S and horizontal tilt HT of the wheels. As shown in FIG. 5B, both features 77' and 79' have relatively large peak to valley variations associated with them. They are therefore indicative of poor wafer nanotopology and can significantly affect ability to print miniaturized circuitry on wafer surfaces.

Misalignment of hydrostatic pad and grinding wheel clamping planes 71' and 73' causing nanotopology degradation can be corrected by regularly aligning the clamping planes. But the dynamics of the grinding operation as well as the effects of differential wear on the grinding wheels 9' cause the planes to diverge from alignment after a relatively small number of operations. Alignment steps, which are highly time consuming, may be required so often as to make it a commercially impractical way of controlling operation of the grinder.

Accordingly, there is a need for a hydrostatic pad usable in a wafer-clamping device of a double side grinder capable of effectively holding semi-conductor wafers for processing but still forgiving to movement of grinding wheels so that degradation of wafer surface nanotopology is minimized upon repeated grinder operation.

SUMMARY OF THE INVENTION

One aspect is a single set-up of a double side grinder in a double side grinding process forms a set of semiconductor wafers. Each wafer has an improved nanotopology with average peak to valley variations less than about 12 nm. Generally, each wafer is formed by positioning the wafer between a first and second hydrostatic pad and between a first and second grinding wheel. The grinding wheels are located within an opening of each the first and second pad. The wafer is held between the pads and the wheels so that no appreciable clamping pressure is applied to the held wafer adjacent peripheral edges of the grinding wheels and adjacent peripheral edges of the openings in the pads.

Another aspect is a method of holding a workpiece in a double side grinder. The method comprises positioning the workpiece between a first hydrostatic pad and a second hydrostatic pad and between a first grinding wheel and a second grinding wheel located within an opening of each of the first hydrostatic pad and second hydrostatic pad. The workpiece is then held between the hydrostatic pads and between the grinding wheels so that substantially no clamping pressure is applied to the held workpiece adjacent peripheral edges of the grinding wheels and adjacent peripheral edges of the openings in the pads.

Yet another aspect is a method of grinding a wafer in a double side grinder. The method comprises positioning the wafer between a first and second hydrostatic pad. The hydrostatic pads each have a body for holding the workpiece during grinding of the wafer and the bodies each have a working surface area and an opening formed therein for receiving a grinding wheel into engagement with the wafer. The bodies also each have a free region formed in the body between a peripheral edge of each opening and a pocket for receiving fluid and providing a barrier between the body and the wafer. The pockets also have a pocket surface area. The wafer is then held between the first and second hydrostatic pads and between the grinding wheels such that the hydrostatic pads apply substantially no clamping pressure to the wafer at the free region. The wafer is then ground with the grinding wheels while the wafer is held between the first and second hydrostatic pads.

Other features of the invention will be in part apparent and in part pointed out hereinafter.

BRIEF DESCRIPTION OF THE DRAWINGS

Corresponding reference characters indicate corresponding parts throughout the several views of the drawings.

DETAILED DESCRIPTION OF THE INVENTION

Figure 6:
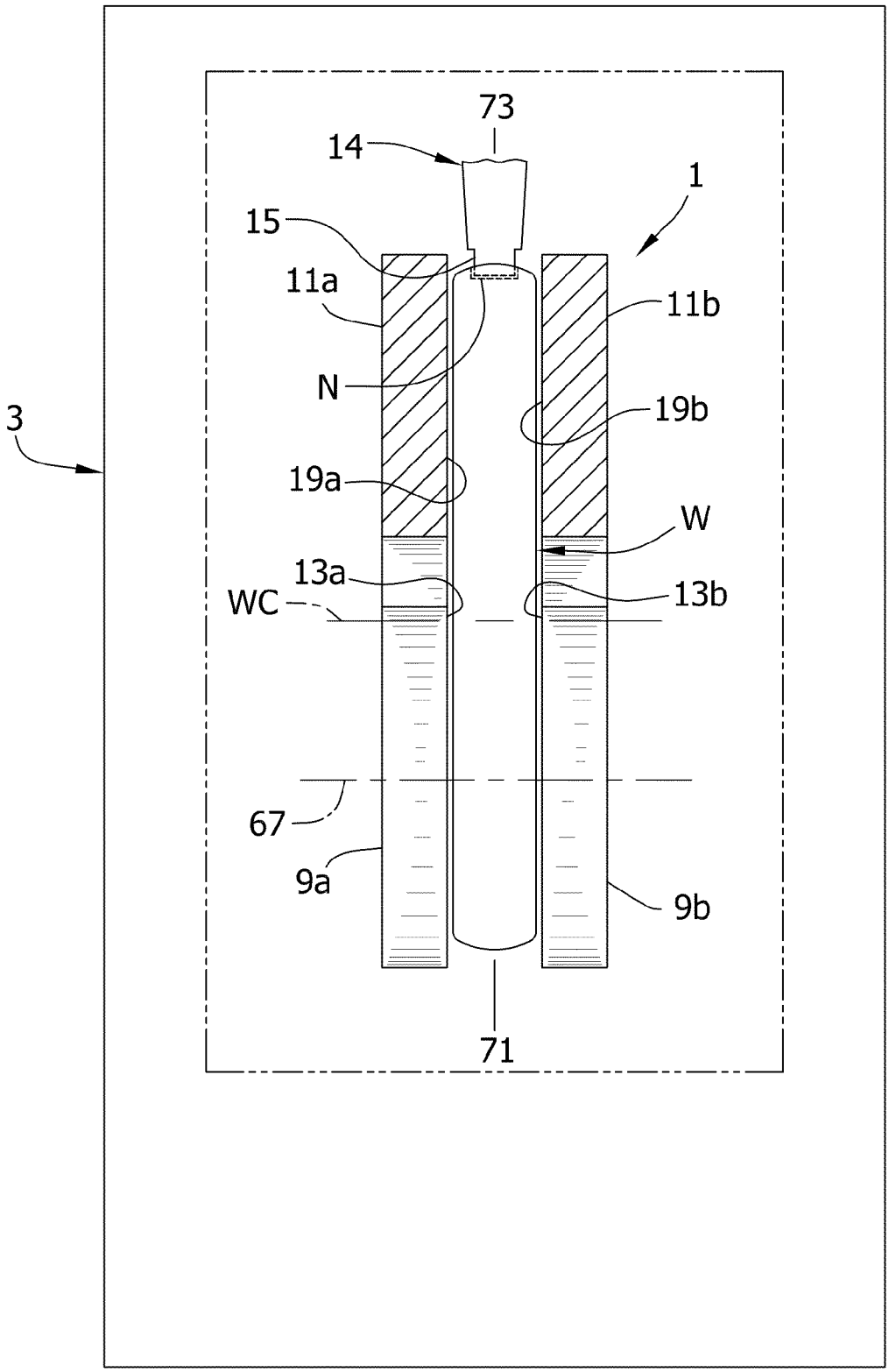
FIG. 6 is a schematic side elevation of a grinder incorporating a wafer-clamping device of the present invention with hydrostatic pads shown in section.
Figure 7:
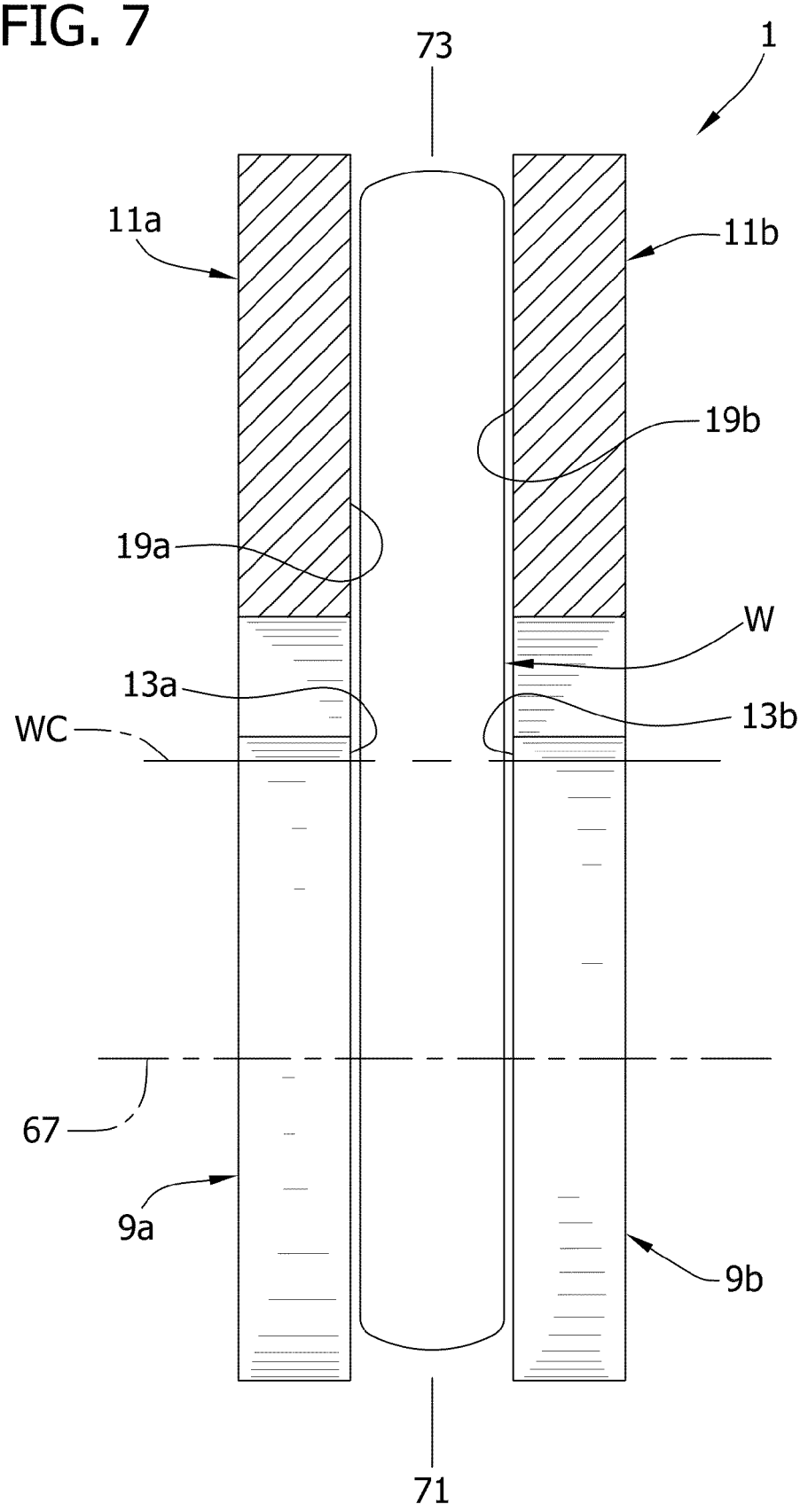
FIG. 7 is an enlarged schematic side elevation of the wafer-clamping device thereof, including the hydrostatic pads and grinding wheels with a semiconductor wafer positioned therebetween.

Referring again to the drawings, FIGS. 6 and 7 schematically show a wafer-clamping device according to the invention, designated generally at reference numeral 1. The clamping device is capable of being used in a double side grinder, which is designated generally at reference numeral 3 in FIG. 6. An example of a double side grinder in which the wafer clamping device 1 may be used includes model DXSG320 and model DXSG300A manufactured by Koyo Machine Industries Co., Ltd. The wafer-clamping device 1 holds a single semiconductor wafer (broadly, "a workpiece"), designated generally at W in the drawings, in a vertical position within the grinder 3 so that both surfaces of the wafer can be uniformly ground at the same time. This improves flatness and parallelism of the wafer's surfaces prior to steps of polishing and circuitry printing. It is understood that a grinder may have a clamping device that holds workpieces other than semiconductor wafers without departing from the scope of the invention.

As also shown in FIGS. 6 and 7, the wafer-clamping device 1 includes left and right grinding wheels, designated generally by reference numerals 9*a* and 9*b*, respectively, and left and right hydrostatic pads, designated by reference numerals 11*a* and 11*b*, respectively. The left and right designations are made for ease of description only and do not mandate any particular orientation of the wheels 9*a* and 9*b* and pads 11*a* and 11*b*. The letters "a" and "b" are used to distinguish parts of the left wheel 9*a* and left pad 11*a* from those of the right wheel 9*b* and right pad 11*b*. The grinding wheels 9*a* and 9*b* and hydrostatic pads 11*a* and 11*b* are mounted in the grinder 3 by means known to those of skill in the art.

As is also known in the art, the two grinding wheels 9*a* and 9*b* are substantially identical, and each wheel is generally flat. As seen in FIGS. 6 and 7, the grinding wheels 9*a* and 9*b* are generally positioned for grinding engagement with the wafer W toward a lower center of the wafer. A periphery of each wheel 9*a* and 9*b* extends below the periphery of the wafer W at the bottom of the wafer, and extends above a central axis WC of the wafer at the wafer's center. This ensures the entire surface area of each wafer W is ground during operation. In addition, at least one of the grinding wheels 9*a* or 9*b* can move relative to its paired grinding wheel. This facilitates loading the semiconductor wafer W in position between the grinding wheels 9*a* and 9*b* in the clamping device 1 of the grinder 3. Also in the illustrated clamping device 1, the left hydrostatic pad 11*a* can move relative to the corresponding left grinding wheel 9*a* and can also move relative to the right hydrostatic pad 11*b*, which remains fixed, to further facilitate loading the semiconductor wafer W into the device 1. A wafer-clamping device in which both pads are movable relative to corresponding grinding wheels or in which both pads are fixed during wafer loading, or a wafer-clamping device in which a hydrostatic pad and corresponding grinding wheel move together during wafer loading do not depart from the scope of the invention.

Still referring to the wafer-clamping device 1 shown in FIGS. 6 and 7, during grinding operation, the two grinding wheels 9*a* and 9*b* and two hydrostatic pads 11*a* and 11*b* of the wafer-clamping device are arranged in opposed relation for holding the semiconductor wafer W therebetween. The grinding wheels 9*a* and 9*b* and hydrostatic pads 11*a* and 11*b* define vertical clamping planes 71 and 73, respectively, and produce clamping pressures on the wafer W that help hold the wafer in its vertical position. This will be described in more detail hereinafter.

Referring particularly to FIG. 6, the hydrostatic pads 11*a* and 11*b* remain stationary during operation while a drive ring, designated generally by reference numeral 14, moves the wafer W in rotation relative to the pads and grinding wheels 9*a* and 9*b*. As is known in the art, a detent, or coupon 15, of the drive ring 14 engages the wafer W generally at a notch N (illustrated by broken lines in FIG. 6) formed in a periphery of the wafer to move the wafer in rotation about its central axis WC (central axis WC generally corresponds to horizontal axes 44*a* and 44*b* of pads 11*a* and 11*b* (see FIGS. 8 and 12)). At the same time, the grinding wheels 9*a* and 9*b* engage the wafer W and rotate in opposite directions to one another. One of the wheels 9*a* and 9*b* rotates in the same direction as the wafer W and the other rotates in an opposite direction to the wafer.

Figure 10:
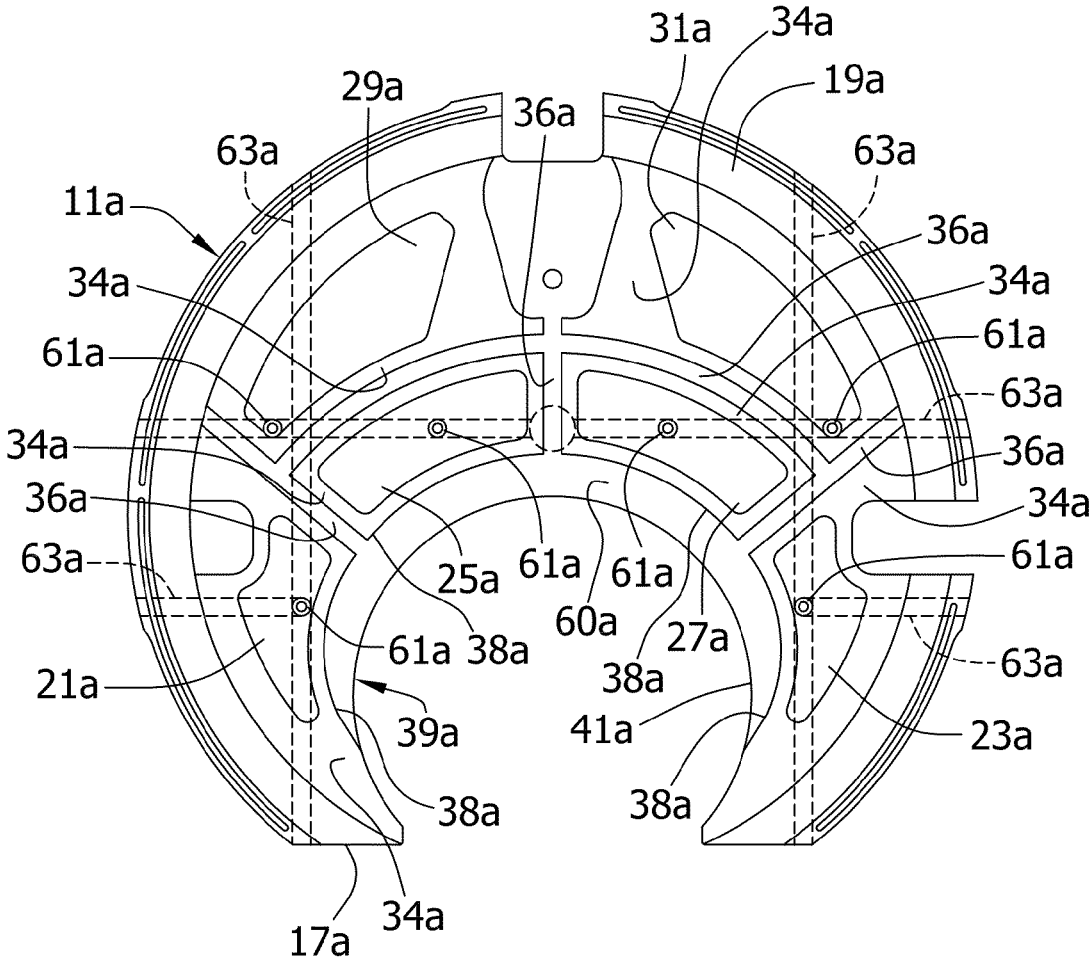
FIG. 10 is a wafer-side elevation similar to FIG. 9A showing channels connecting fluid injection ports within the hydrostatic pockets of the pad.
Figure 11:
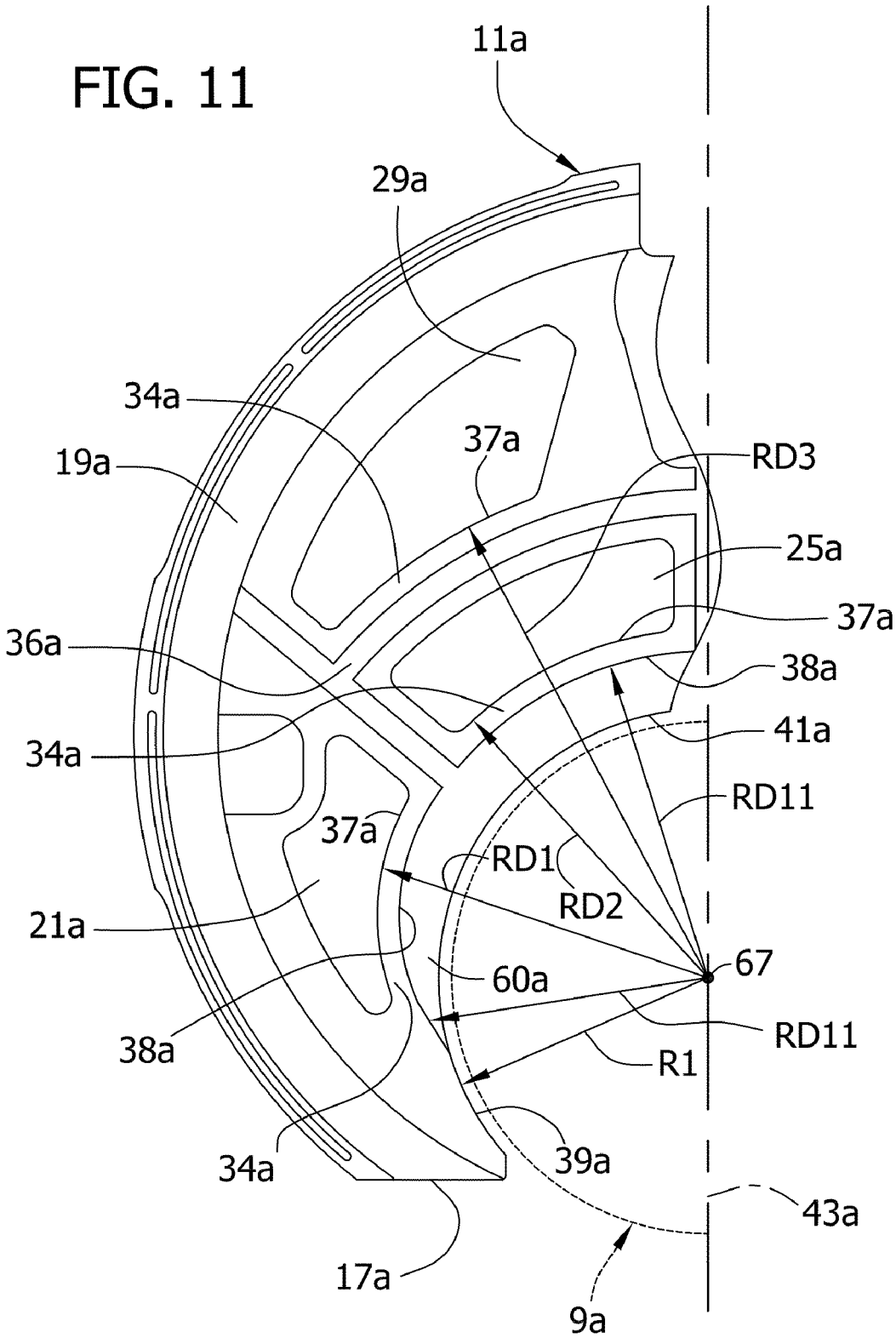
FIG. 11 is an enlarged fragmentary elevation of the hydrostatic pad of FIG. 9A illustrating location of hydrostatic pockets relative to a grinding wheel opening of the pad.
Figure 12:
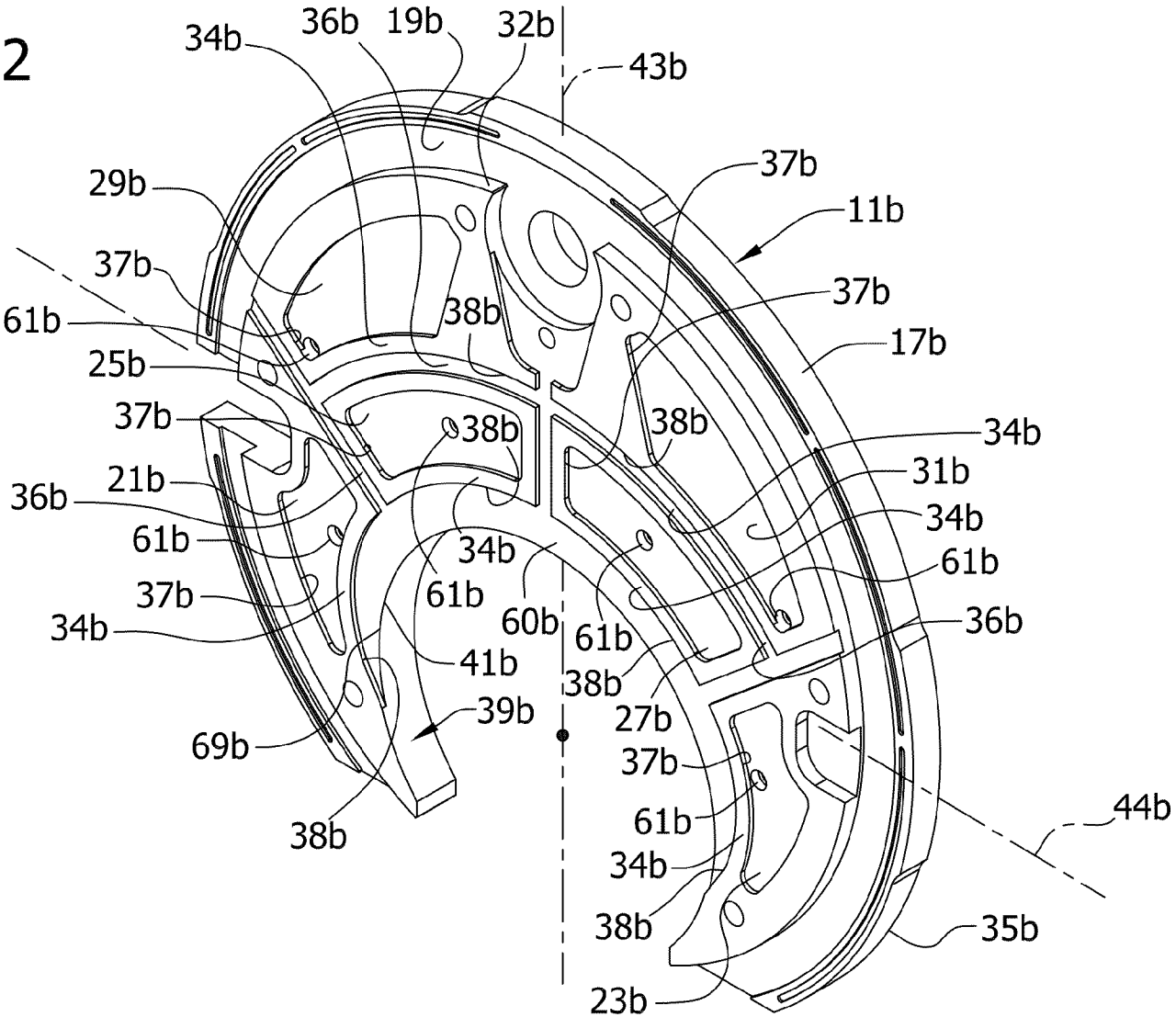
FIG. 12 is a perspective similar to FIG. 8 of a right hydrostatic pad, which opposes the left hydrostatic pad during grinding operation such that a wafer can be held between the two pads.
Figure 13A:
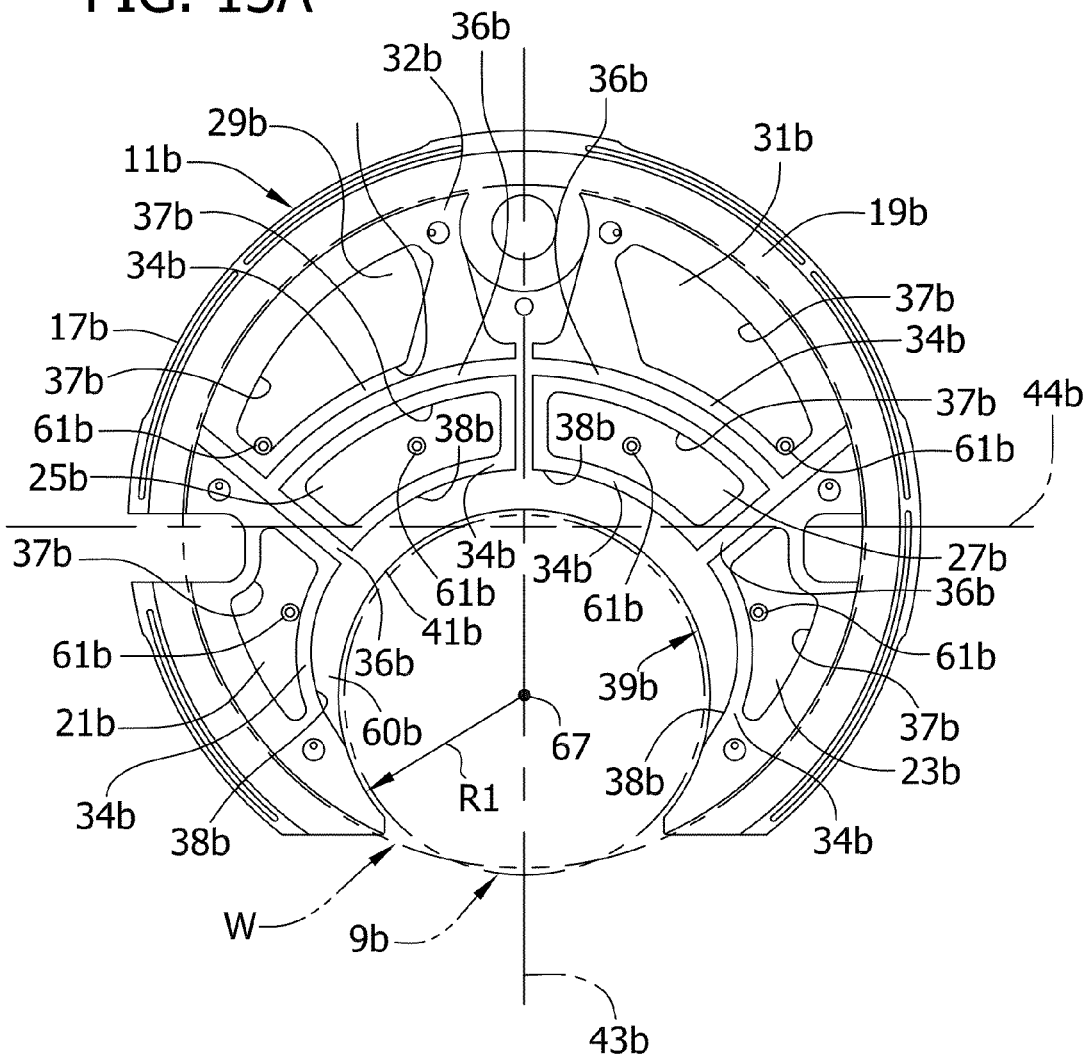
FIG. 13A is an elevation similar to FIG. 9A of the right hydrostatic pad.
Figure 13B:
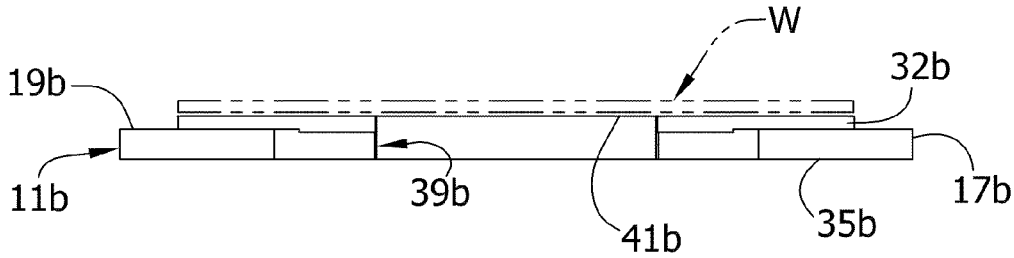
FIG. 13B is a bottom plan thereof.

Referring now to FIGS. 8-13B, the hydrostatic pads 11*a* and 11*b* of the invention are shown in greater detail. FIGS. 8-11 illustrate the left hydrostatic pad 11*a*, and FIGS. 12-13B illustrate the opposing right hydrostatic pad 11*b*. As can be seen, the two pads 11*a* and 11*b* are substantially identical and are generally mirror images of each other. Therefore, only the left pad 11*a* will be described with it understood that a description of the right pad 11*b* is the same.

Figure 8:
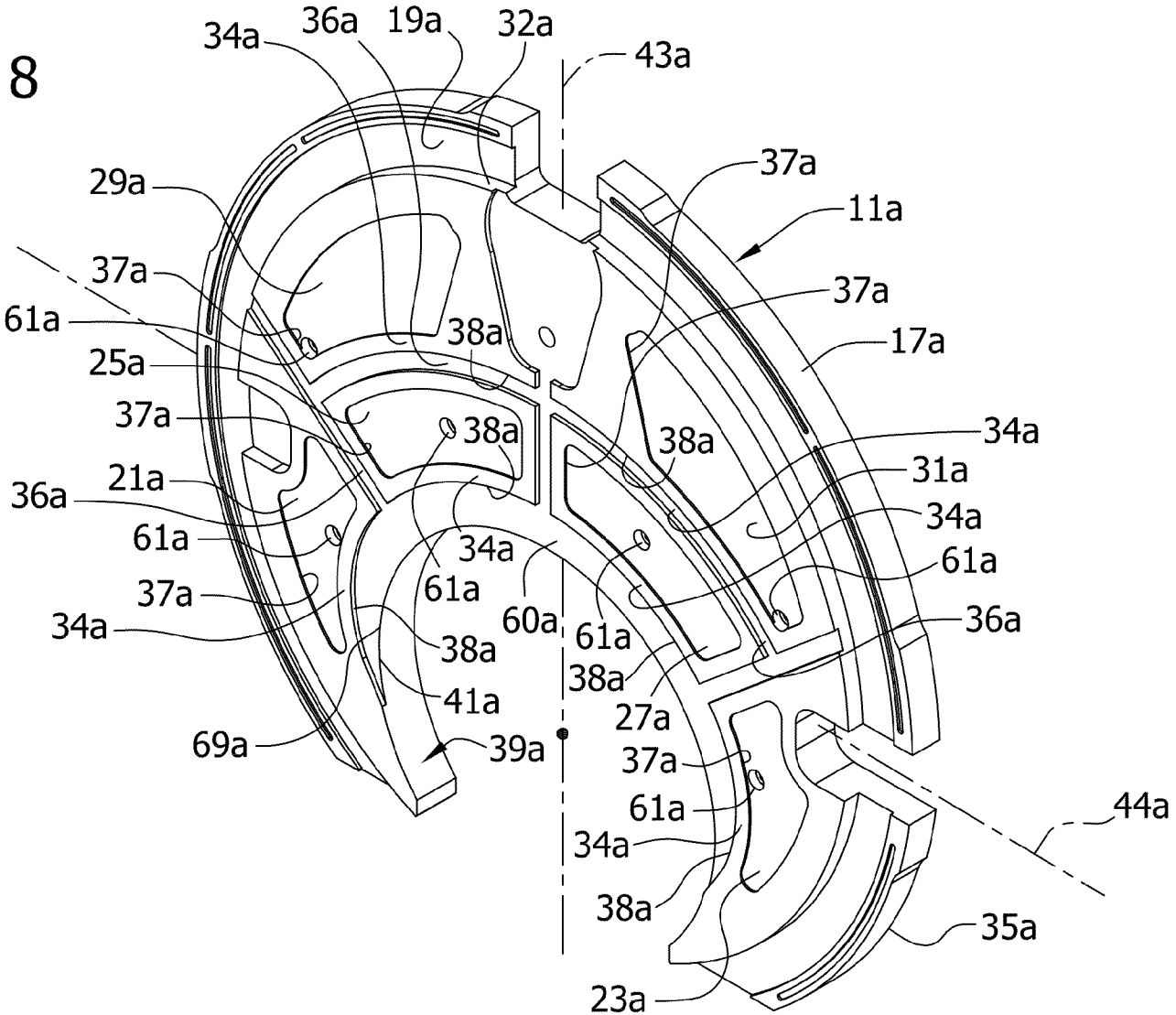
FIG. 8 is a perspective of a left hydrostatic pad of the present invention, showing hydrostatic pocket configuration of a face of the pad that opposes the wafer during grinding operation.
Figure 9A:
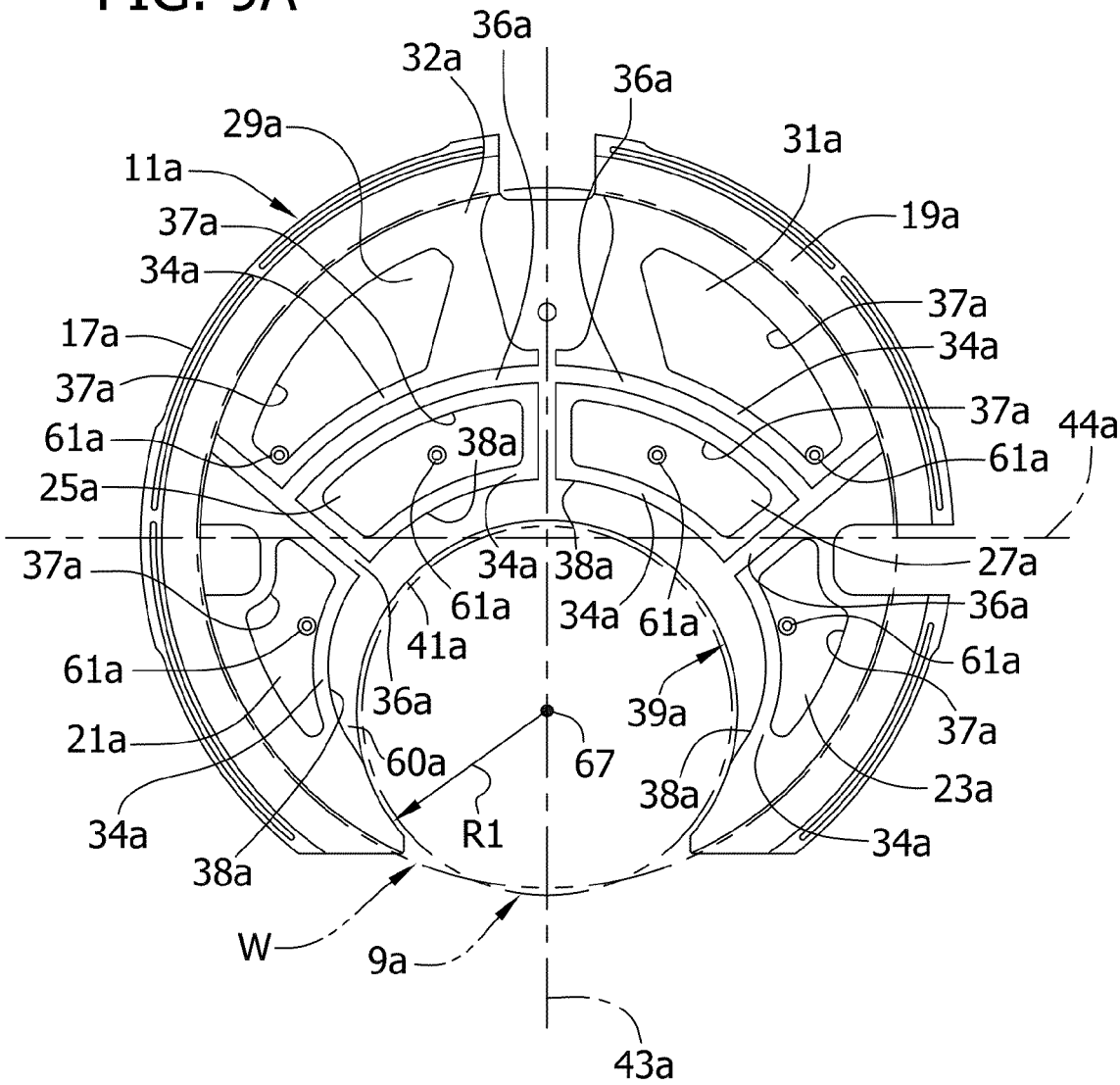
FIG. 9A is a wafer-side elevation of the left hydrostatic pad of FIG. 8, showing a grinding wheel and the wafer in phantom to illustrate their positional relationships with the pad.
Figure 9B:
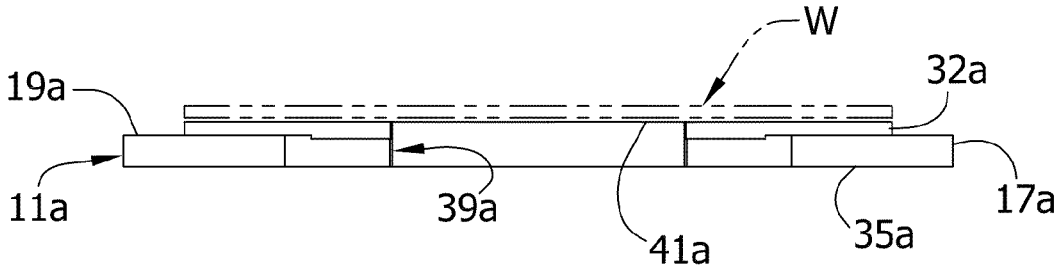
FIG. 9B is a bottom plan of the hydrostatic pad of FIG. 9A with the wafer again shown in phantom.

As shown in FIGS. 8-9B, the left hydrostatic pad 11*a* is generally thin and circular in shape and has a size similar to the wafer W being processed. The wafer W is illustrated in phantom in FIGS. 9A and 9B to show this relationship. The illustrated hydrostatic pad 11*a* has a diameter of about 36.5 cm (14.4 in) and a working surface area facing the wafer W during operation of about 900 $cm^2$ (139.5 $in^2$). It is therefore capable of being used to grind standard wafers having diameters, for example, of about 300 mm. It should be understood, though, that a hydrostatic pad might have a different diameter and surface area without departing from the scope of the invention. For example, a pad may be sized on a reduced scale for use to grind a 200 mm wafer.

As best seen in FIGS. 8 and 9A, a body 17*a* of the hydrostatic pad 11*a* includes a wafer side face 19*a* immediately opposite the wafer W during the grinding operation. Six hydrostatic pockets 21*a*, 23*a*, 25*a*, 27*a*, 29*a* and 31*a* formed in the wafer side face 19*a* are each positioned generally radially about a grinding wheel opening (indicated generally by reference numeral 39*a*) of the pad 11*a*. A back side 35*a* of the pad body 17*a*, opposite the wafer side face 19*a*, is generally flat and free of hydrostatic pockets, but could include pockets without departing from the scope of the invention. In addition, a hydrostatic pad with more or fewer than six hydrostatic pockets, for example, four pockets, does not depart from the scope of the invention.

The six hydrostatic pockets 21*a*, 23*a*, 25*a*, 27*a*, 29*a*, and 31*a* are each arcuate in shape and elongate in a generally circumferential direction around the pad 11*a*. Each pocket 21*a*, 23*a*, 25*a*, 27*a*, 29*a*, and 31*a* is recessed into a raised surface 32*a* of the wafer side face 19*a*, and each includes relatively flat vertical sidewalls 37*a* and rounded perimeter corners. The pockets are formed by cutting or casting shallow cavities into the face 19*a* of the pad 11*a*. Hydrostatic pockets formed by different processes do not depart from the scope of the invention.

Figure 1:
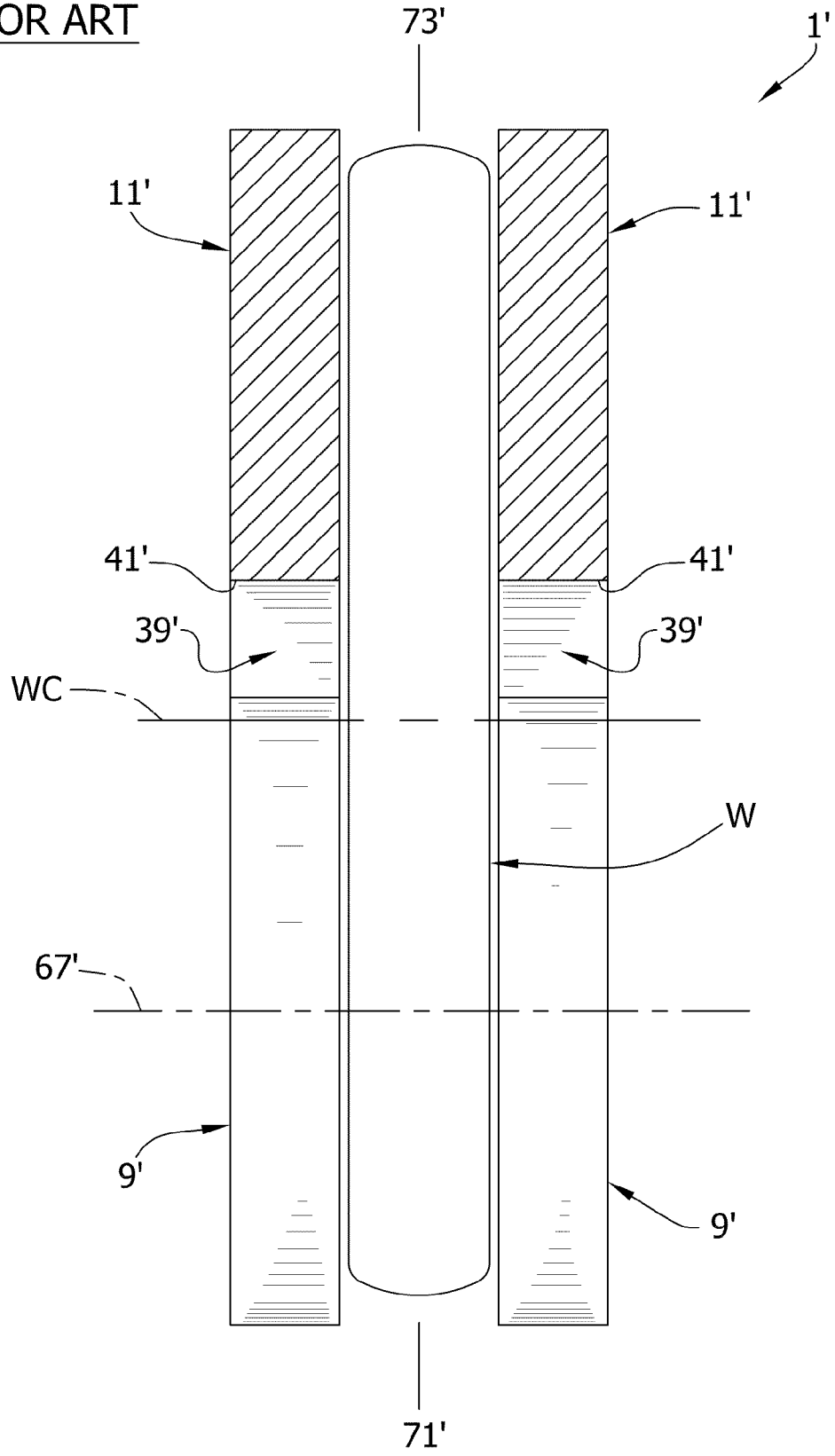
FIG. 1 PRIOR ART
FIG. 1 is a schematic side elevation of a wafer-clamping device of the prior art, including hydrostatic pads and grinding wheels with a semiconductor wafer positioned therebetween and the hydrostatic pads shown in section.
Figure 2:
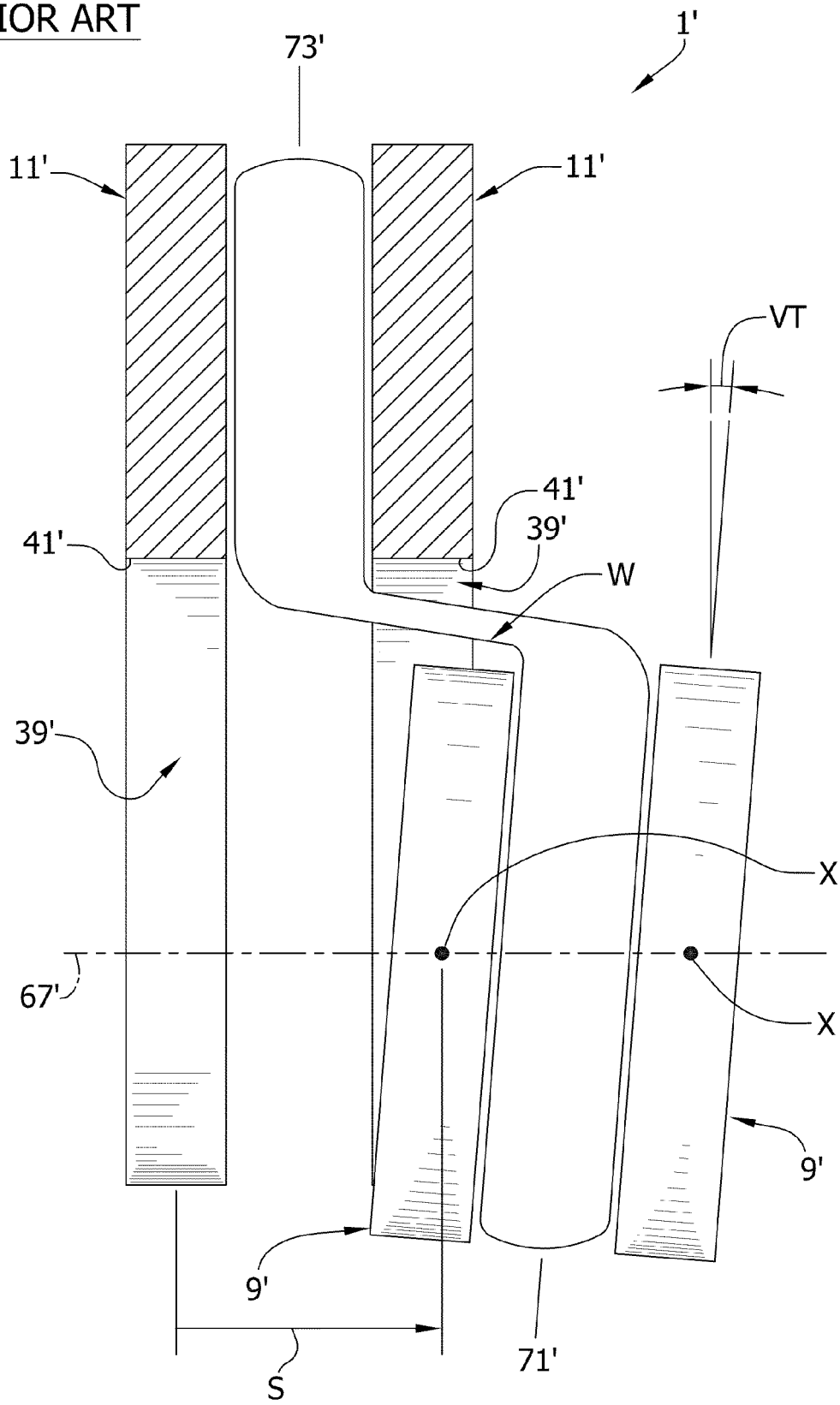
FIG. 2 PRIOR ART
FIG. 2 is a schematic side elevation similar to FIG. 1, but with the grinding wheels laterally shifted and vertically tilted.
Figure 3:
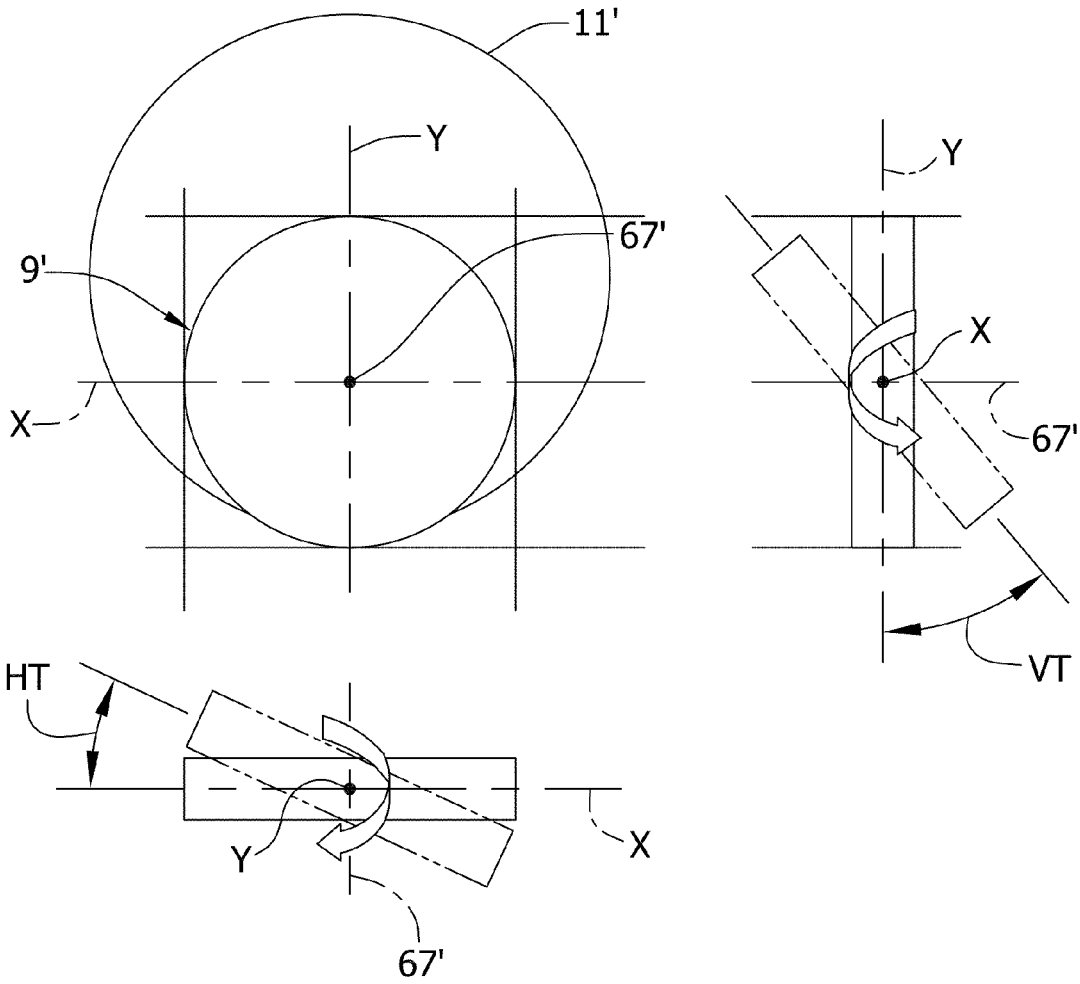
FIG. 3 PRIOR ART
FIG. 3 is a schematic front elevation thereof illustrating horizontal tilt and vertical tilt of a grinding wheel.
Figure 4:
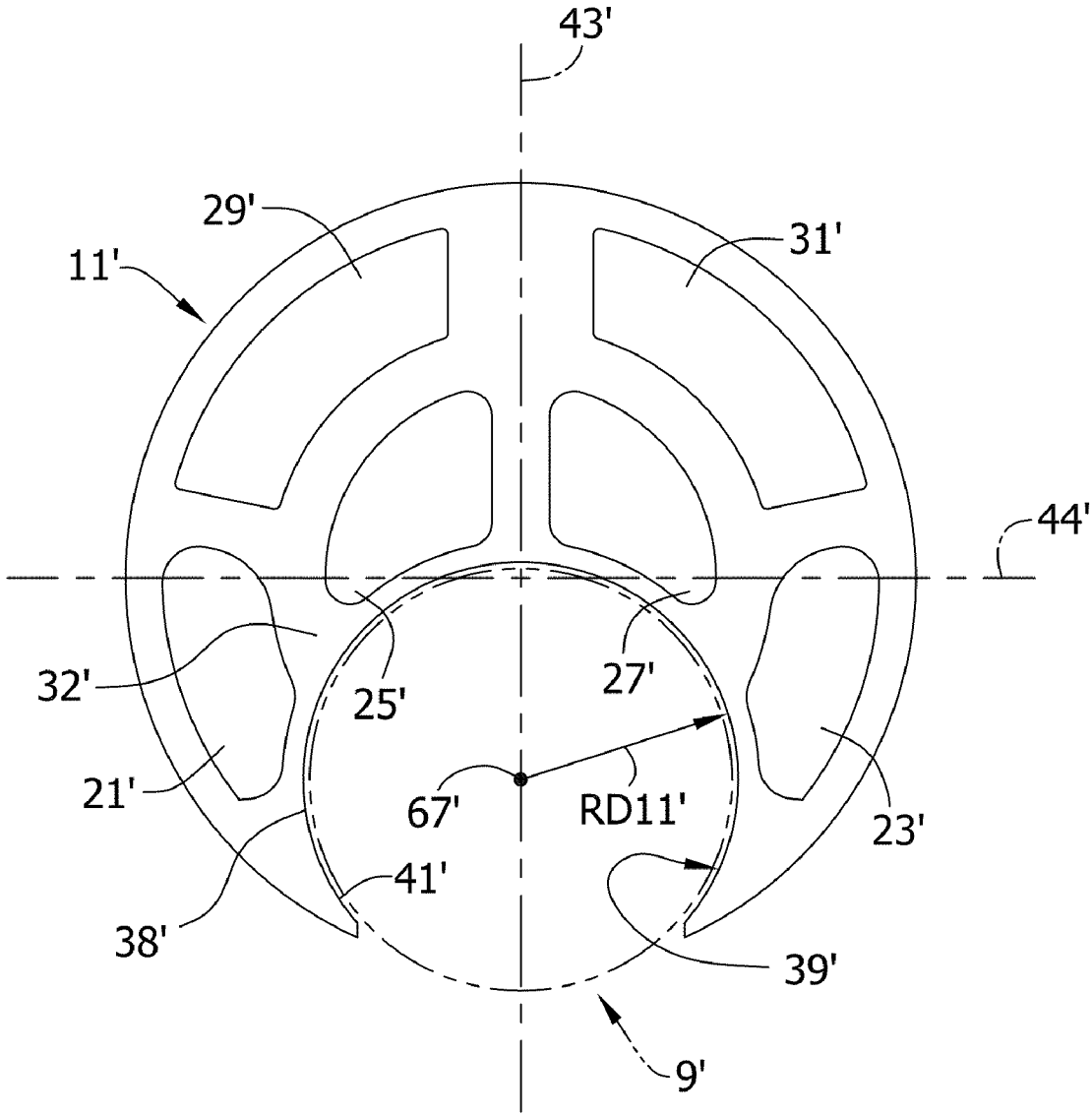
FIG. 4 PRIOR ART
FIG. 4 is a schematic of a wafer side of one of the prior art hydrostatic pads of FIG. 1.

Still referring to FIGS. 8 and 9A, it can be seen that each of the pairs of pockets 21*a* and 23*a*, 25*a* and 27*a*, and 29*a* and 31*a* are substantially the same size and shape. Moreover, in the illustrated pad 11*a*, pockets 21*a* and 23*a* each have a surface area of about 14.38 $cm^2$ (2.23 $in^2$); pockets 25*a* and 27*a* each have a surface area of about 27.22 $cm^2$ (4.22 $in^2$); and pockets 29*a* and 31*a* each have a surface area of about 36.18 $cm^2$ (5.61 $in^2$). A total pocket surface area of pad 11*a* is about 155.56 $cm^2$ (24.11 $in^2$) and a ratio of total pocket surface area to the working surface area of the pad is about 0.17. This ratio can be other than 0.17 and still be within the scope of the present invention. For example, the ratio may be about 0.26 or less. By comparison in prior art pads 11' (FIG. 4), a surface area of each of pockets 21' and 23' is about 31.82 $cm^2$ (4.93 $in^2$); a surface area of each of pockets 25' and 27' is about 36.47 $cm^2$ (5.65 $in^2$); and a surface area of each of pockets 29' and 31' is about 47.89 $cm^2$ (7.42 $in^2$). A total pocket surface area of the prior art pad 11' is about 232.36 $cm^2$ (36.02 $in^2$), and a ratio of total pocket surface area to pad working surface area is about 0.26 (the working surface area for pad 11' is about 900 $cm^2$ (139.5 $in^2$)).

Pockets 21*a* and 23*a*, 25*a* and 27*a*, and 29*a* and 31*a*, respectively, are also symmetrically located on opposite halves of the wafer side face 19*a* (as separated by vertical axis 43*a* of the pad 11*a*). Pockets 21*a* and 23*a* are generally below horizontal axis 44*a* of the pad 11*a*, while pockets 25*a*, 27*a*, 29*a*, and 31*a* are generally above axis 44*a*. Pockets 29*a* and 31*a* are generally above pockets 25*a* and 27*a* and are not located adjacent grinding wheel opening 39*a*, but are spaced away from the opening with pockets 25*a* and 27*a* located therebetween. In this pocket orientation, about 15% of the total pocket surface area is located below horizontal axis 44*a*. This percentage can be 23% or less without departing from the scope of the invention. By comparison in prior art pads 11', at least about 24% of the total pocket surface area is located below the pad's horizontal axis 44'. It should be understood that increased pocket area below axis 44' increases clamping force applied on the wafer by pad 11' toward the sides of grinding wheel opening 39' and contributes to B-ring formation.

FIGS. 8 and 9A show the circular grinding wheel opening 39*a* that is formed in a lower portion of the body 17*a* of the hydrostatic pad 11*a* and is sized and shaped for receiving grinding wheel 9*a* through the pad and into engagement with the lower center of the wafer W (the grinding wheel and wafer are illustrated in phantom in FIG. 9A). A center of opening 39*a* generally corresponds to rotational axis 67 of grinding wheel 9*a* (and 9*b*) when received in the opening. In the illustrated pad 11*a*, a radius R1 of grinding wheel opening 39*a* is about 87 mm (3.43 in) and a distance between peripheral edges of the grinding wheel 9*a* and radially opposed edge 41*a* of the grinding wheel opening is relatively uniform and is generally on the order of about 5 mm (0.20 in). These distances can be different without departing from the scope of the invention.

As also shown, raised surface 32*a* of pad 11*a* comprises coextensive plateaus 34*a* extending around the perimeter of each pocket 21*a*, 23*a*, 25*a*, 27*a*, 29*a*, and 31*a*. Drain channels, each designated by reference numeral 36*a*, are formed in the raised surface 32*a* between each plateau 34*a* of the pockets 21*a*, 23*a*, 25*a*, 27*a*, 29*a*, and 31*a*. A roughly crescent shaped free region 60*a* is recessed into the raised surface between grinding wheel opening peripheral edge 41*a* and edges 38*a* of inner portions of plateaus 34*a* of pockets 21*a*, 23*a*, 25*a*, and 27*a*. Clamping force on the wafer W is effectively zero at free region 60*a*. These features will be further explained hereinafter.

Referring now to FIG. 10, hydrostatic pockets 21*a*, 23*a*, 25*a*, 27*a*, 29*a*, and 31*a* each include a fluid injection port 61*a* for introducing fluid into the pockets. Channels 63*a* (illustrated by hidden lines) within the pad body 17*a* interconnect the fluid injection ports 61*a* and supply the fluid from an external fluid source (not shown) to the pockets. The fluid is forced into the pockets 21*a*, 23*a*, 25*a*, 27*a*, 29*a*, and 31*a* under relatively constant pressure during operation such that the fluid, and not the pad face 19*a*, contacts the wafer W during grinding. In this manner, the fluid at pockets 21*a*, 23*a*, 25*a*, 27*a*, 29*a*, and 31*a* holds the wafer W vertically within pad clamping plane 73 (see FIGS. 6 and 7) but still provides a lubricated bearing area, or sliding barrier, that allows the wafer W to rotate relative to the pad 11*a* (and 11*b*) during grinding with very low frictional resistance. Clamping force of the pad 11*a* is provided primarily at pockets 21*a*, 23*a*, 25*a*, 27*a*, 29*a*, and 31*a*.

FIG. 11 shows orientation of pockets 21*a*, 25*a*, and 29*a* in more detail with reference to a left half of the wafer side face 19*a* of pad 11*a*. Radial distances RD1, RD2, and RD3 indicate location of peripheral edges of the nearest vertical side wall 37*a* of pockets 21*a*, 25*a*, and 29*a*, respectively (the nearest vertical sidewall 37*a* refers to the vertical side wall closest to edge 41*a* of grinding wheel opening 39*a*) from the center of the grinding wheel opening, which ideally corresponds to grinding wheel rotational axis 67. As illustrated, distance RD1 is nonconstant around nearest vertical sidewall 37*a* of pocket 21*a* such that a bottom end of pocket 21*a* is further from opening 39*a* than a top end. Specifically, distance RD1 ranges from about 104 mm (4.1 in) toward the bottom end of the pocket to about 112 mm (4.4 in) toward the top end (these values are the same for pocket 23*a*). Radial distances RD2 and RD3 are relatively constant to nearest vertical walls 37*a* of pockets 25*a* and 29*a*, respectively, with RD2 having a value of about 113 mm (4.4 in) and RD3 having a value of about 165 mm (6.5 in) (these values are the same for pockets 27*a* and 31*a*, respectively). Radial distance RD1 may be constant and radial distances RD2 and RD3 may be nonconstant without departing from the scope of the invention.

FIG. 11 also shows radial distance RD11 measured radially from grinding wheel rotational axis 67 to the radially innermost edge 38*a* of plateaus 34*a* of pockets 21*a* and 25*a*. The edge 38*a* defines the end, or boundary, of zero pressure (free) region 60*a*. As can be seen, radial distance RD11 is nonconstant to edge 38*a*, and in illustrated pad 11*a* ranges from about 108 mm (4.25 in) near vertical axis 43*a* to about 87 mm (3.43 in) near the bottom end of pocket 21*a* where edge 38*a* merges with grinding wheel opening edge 41*a*. These same measurements, when made from the peripheral edge of grinding wheel 9*a* (when received in opening 39*a*) to a radially opposed innermost portion of edge 38*a*, range from about 26 mm (1.02 in) near vertical axis 43*a* to about 5 mm (0.20 in)

near the bottom end of pocket 21*a* and form ratios with radius R1 of grinding wheel opening 39*a* ranging from about 0.30 to about 0.057. By comparison, corresponding distances in the prior art hydrostatic pad 11' (FIG. 4) are constant because innermost peripheral edge 38' of the raised surface 32' coincides with grinding wheel opening edge 41' (i.e., there is no zero pressure (free) region in the prior art pad 11'). In this pad 11', radial distance RD11' is about 87 mm (3.43 in) and the same measurement from the peripheral edge of the grinding wheel 9' to edge 38' is about 5 mm (0.20 in).

Hydrostatic pads 11*a* and 11*b* of the invention have at least the following beneficial features as compared to prior art hydrostatic pads 11'. Total hydrostatic pocket surface area is reduced. This effectively reduces overall clamping force applied by the pads on the wafer W because the volume of fluid received into the hydrostatic pockets 21*a*, 23*a*, 25*a*, 27*a*, 29*a*, 31*a*, 21*b*, 23*b*, 25*b*, 27*b*, 29*b*, and 31*b* during operation is reduced. In addition, the pocket surface area below horizontal axis 44*a* is reduced. This specifically lowers clamping forces at the left and right sides of grinding wheel openings 39*a* and 39*b*. Furthermore, inner pockets 21*a*, 23*a*, 25*a*, 27*a*, 21*b*, 23*b*, 25*b*, and 27*b* are moved away from grinding wheel opening edges 41*a* and 41*b* with free regions 60*a* and 60*b* of zero pressure formed therebetween. This specifically lowers clamping forces around edges 41*a* and 41*b* of grinding wheel openings 39*a* and 39*b*.

Figure 5B:
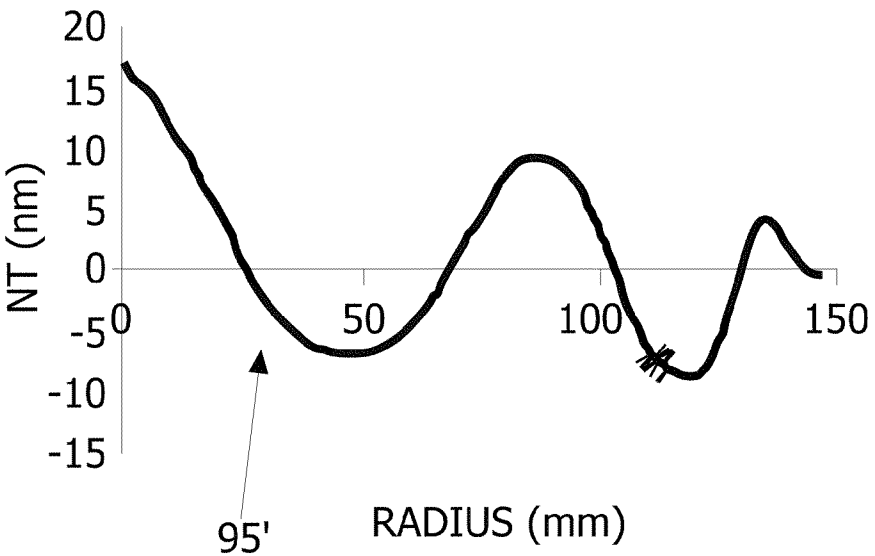
FIG. 5B PRIOR ART
FIG. 5B is a graphical representation of the radial profile of the surface of the wafer of FIG. 5A.
Figure 5A:
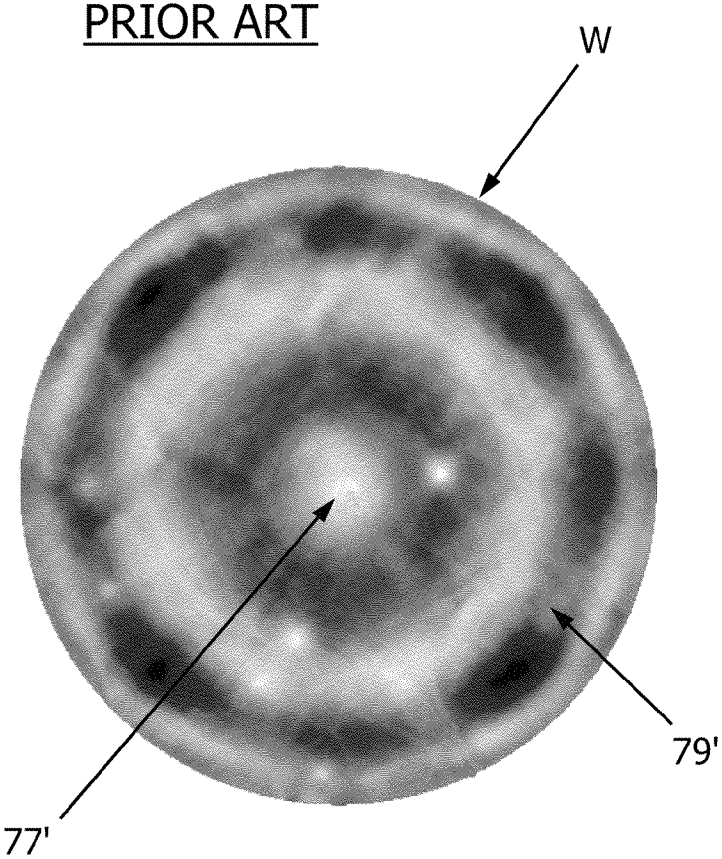
FIG. 5A PRIOR ART
FIG. 5A is a pictorial representation of nanotopology surface features of a semiconductor wafer ground using the wafer-clamping device of FIG. 1 and subsequently polished.
Figure 14:
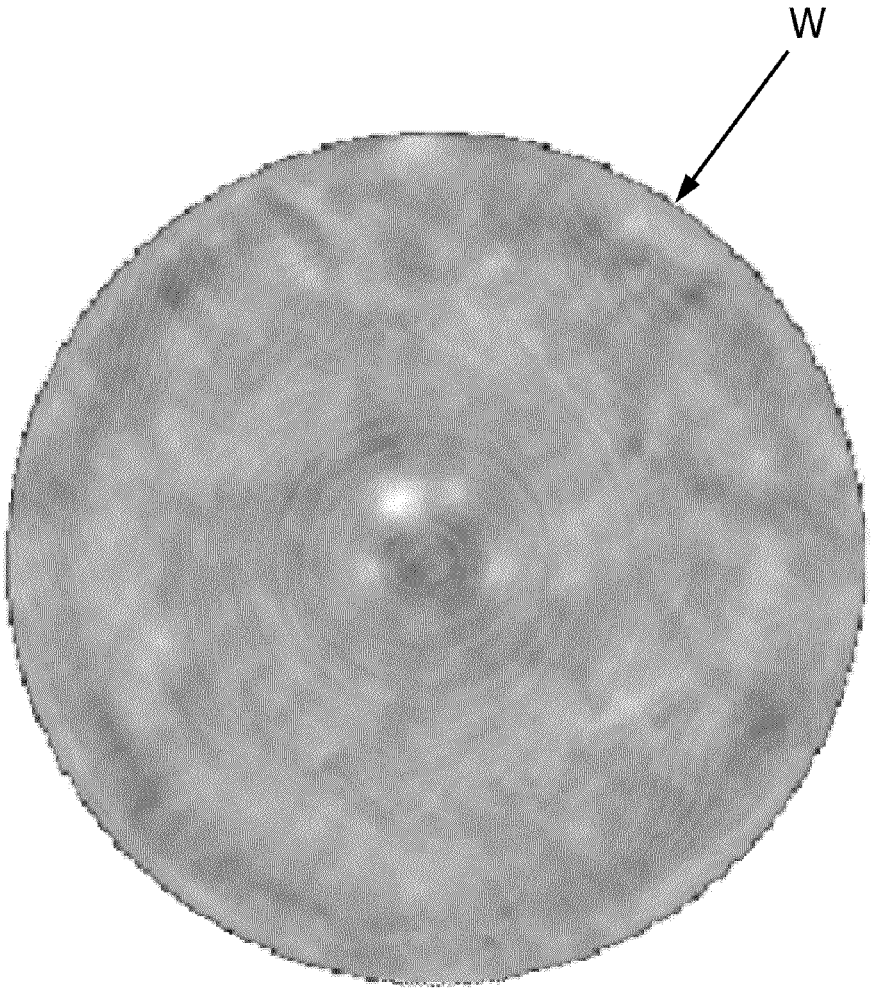
FIG. 14 is pictorial representation similar to FIG. 5A, but showing a semiconductor wafer ground using the wafer-clamping device of FIG. 6 and subsequently polished.

Wafers W are held less rigidly by hydrostatic pads 11*a* and 11*b* during grinding operation so that they can conform more easily to shift and/or tilt movements of grinding wheels 9*a* and 9*b*. This reduces the magnitude of hydrostatic clamping moments that form when grinding wheels 9*a* and 9*b* move (i.e., less stresses form in the bending region of the wafer). In addition, the wafer W is not tightly held adjacent grinding wheel opening edges 41*a*. The wafer W may still bend adjacent grinding wheel opening edge 41*a* when the wheels move, but not as sharply as in prior art grinding devices. Therefore, hydrostatic pads 11*a* and 11*b* promote more uniform grinding over the surfaces of wafers W, and nanotopology degradation, such as formation of B-rings and center-marks, of the ground wafers is reduced or eliminated. This can be seen by comparing FIGS. 5A and 14. FIG. 5A illustrates a wafer W ground using prior art hydrostatic pads 11' while FIG. 14 illustrates a wafer W ground using pads 11*a* and 11*b* of the invention. The wafer shown in FIG. 14 is substantially free of B-rings and center-marks.

Figure 15A:
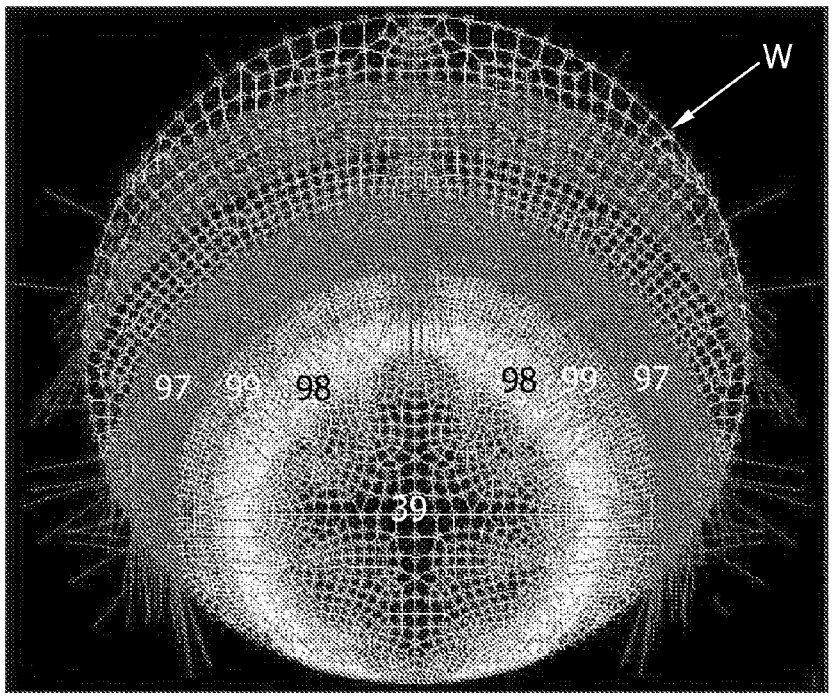
FIG. 15A is a pictorial representation of clamping stresses applied to a surface of a semiconductor wafer during grinding when the wafer is held by hydrostatic pads according to the invention.

FIGS. 15A-19 illustrate the stresses in a wafer W held by pads 11*a* and 11*b* of the invention and by prior art pads 11'. FIGS. 15A and 15B visually illustrate these stresses when grinding wheel and hydrostatic pad clamping planes are aligned. In both wafers W, stress is negligible within grinding wheel openings 39 and 39' (the pad does not clamp the wafer in these regions). FIG. 15A shows the lower stresses formed in wafer W when held by pads 11*a* and 11*b*. It particularly indicates lower stresses (light-color regions indicated at 98 and 99) over the entire surface of wafer W adjacent grinding wheel opening edges 41*a* and 41*b*. It also indicates more uniformly distributed stresses through the wafer. By contrast, and as shown in FIG. 15B, largest stresses 97 in wafer W held by pads 11' are in close proximity to peripheral edges of openings 39' (i.e., there is no zero pressure (free) region).

Figure 15B:
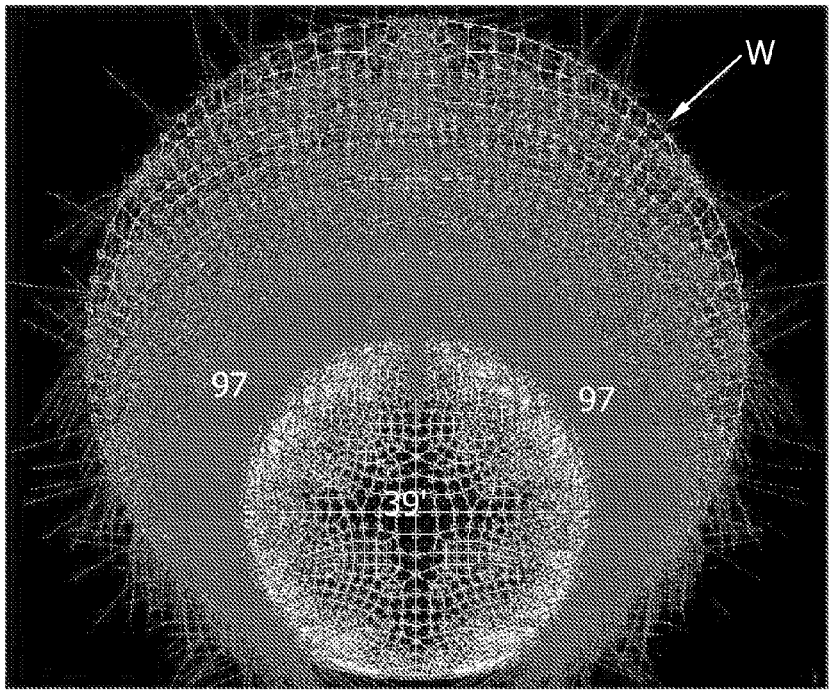
FIG. 15B PRIOR ART
FIG. 15B is a pictorial representation similar to FIG. 15A of clamping stresses on a wafer held by hydrostatic pads of the prior art.

As can also be seen by comparing FIGS. 15A and 15B, concentrated areas of large stress 97 are not as prevalent during grinding using the pads 11*a* and 11*b* as they are when using pads 11' (FIG. 15B). The advantage is both less localized deformation of the wafer W in the bending areas (e.g., adjacent grinding wheel opening edge 41*a*) and more uniform wear of the grinding wheels 9*a* and 9*b*. Uniform wheel wear ensures that the wheels do not change shape during grinding (i.e., no differential wheel wear). This also ensures that the grinder is able to maintain the lower nanotopology settings for longer periods of time. Also, if the wheels do shift or tilt, the stresses caused by the movement are effectively distributed through the wafer W with less pronounced formation of center-marks and B-rings. This desirably makes the grinding nanotopology less sensitive to shifts and tilts of the grinding wheels.

FIGS. 16-19 graphically illustrate lower stresses in wafer W during grinding operation using hydrostatic pads 11*a* and 11*b* when grinding wheels 9*a* and 9*b* shift and/or tilt. The illustrated stresses are those occurring in wafer W adjacent grinding wheel opening edges 41*a* and 41*b* and measured at locations around edges 41*a* and 41*b* beginning at about a seven o'clock position (arc length of 0 mm) and moving clockwise around the perimeter edges (to arc length of about 400 mm). Stresses in wafers W held by prior art hydrostatic pads 11' are designated generally by reference numeral 91 and stresses in wafers held by pads 11*a* and 11*b* are designated generally by reference numeral 93.

Figure 16:
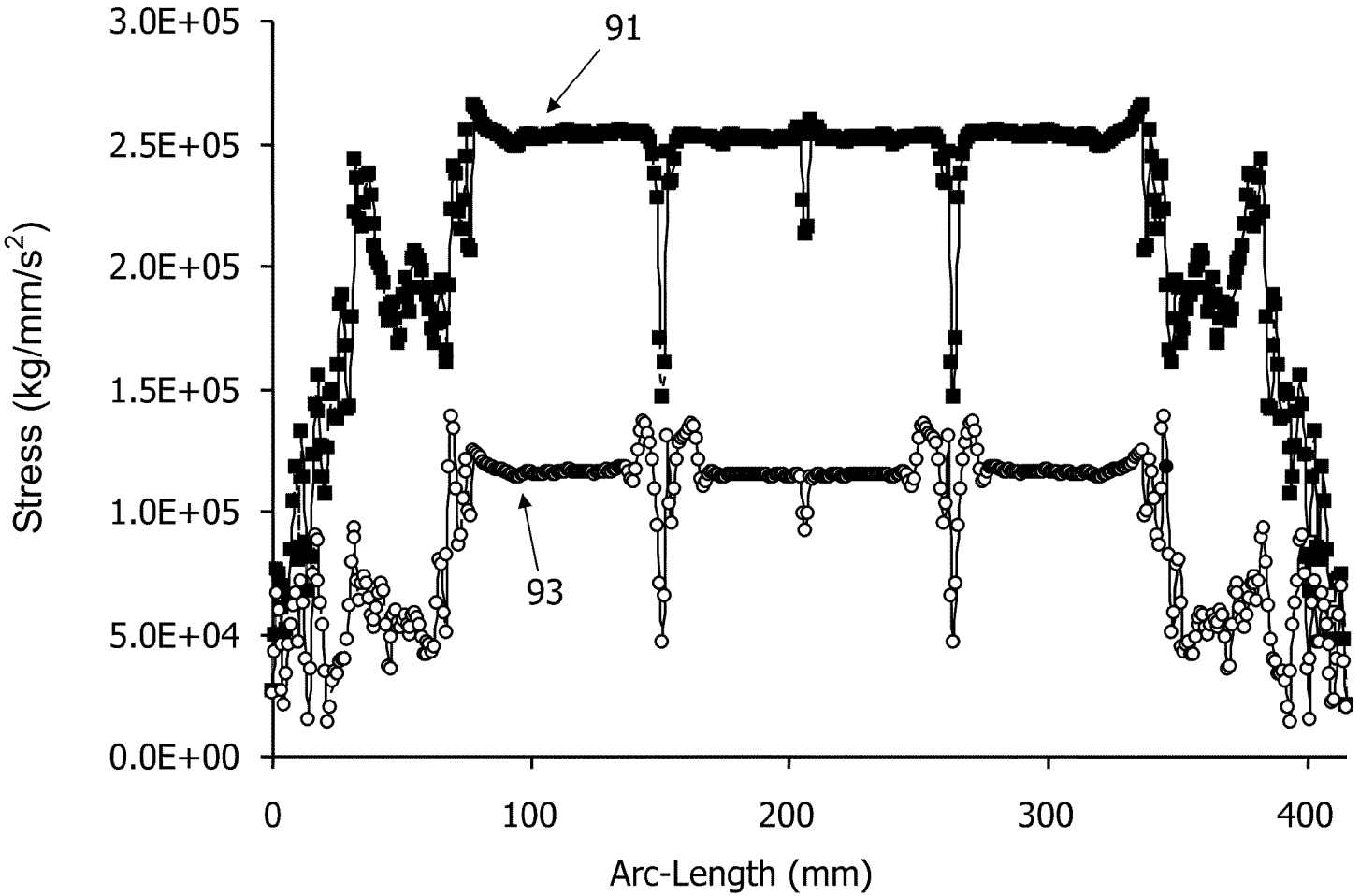
FIG. 16 is a graph showing stresses in semiconductor wafers adjacent a periphery of the grinding wheels during grinding when the grinding wheels laterally shift, and comparing wafers held by hydrostatic pads according to the present invention to wafers held by hydrostatic pads of the prior art.

FIG. 16 illustrates the stresses 91 and 93 when the grinding wheels shift. As can be seen, stresses 93 are significantly less than stresses 91, and are more nearly constant around the entire periphery of grinding wheel openings 39*a* and 39*b* than stresses 91, including at the centers WC of the wafers W (corresponding to an arc length of about 200 mm). Accordingly, in the present invention, when the grinding wheels 9*a* and 9*b* shift, the wafers W do not bend as sharply near their centers as compared to wafers ground in prior art devices.

Figure 17:
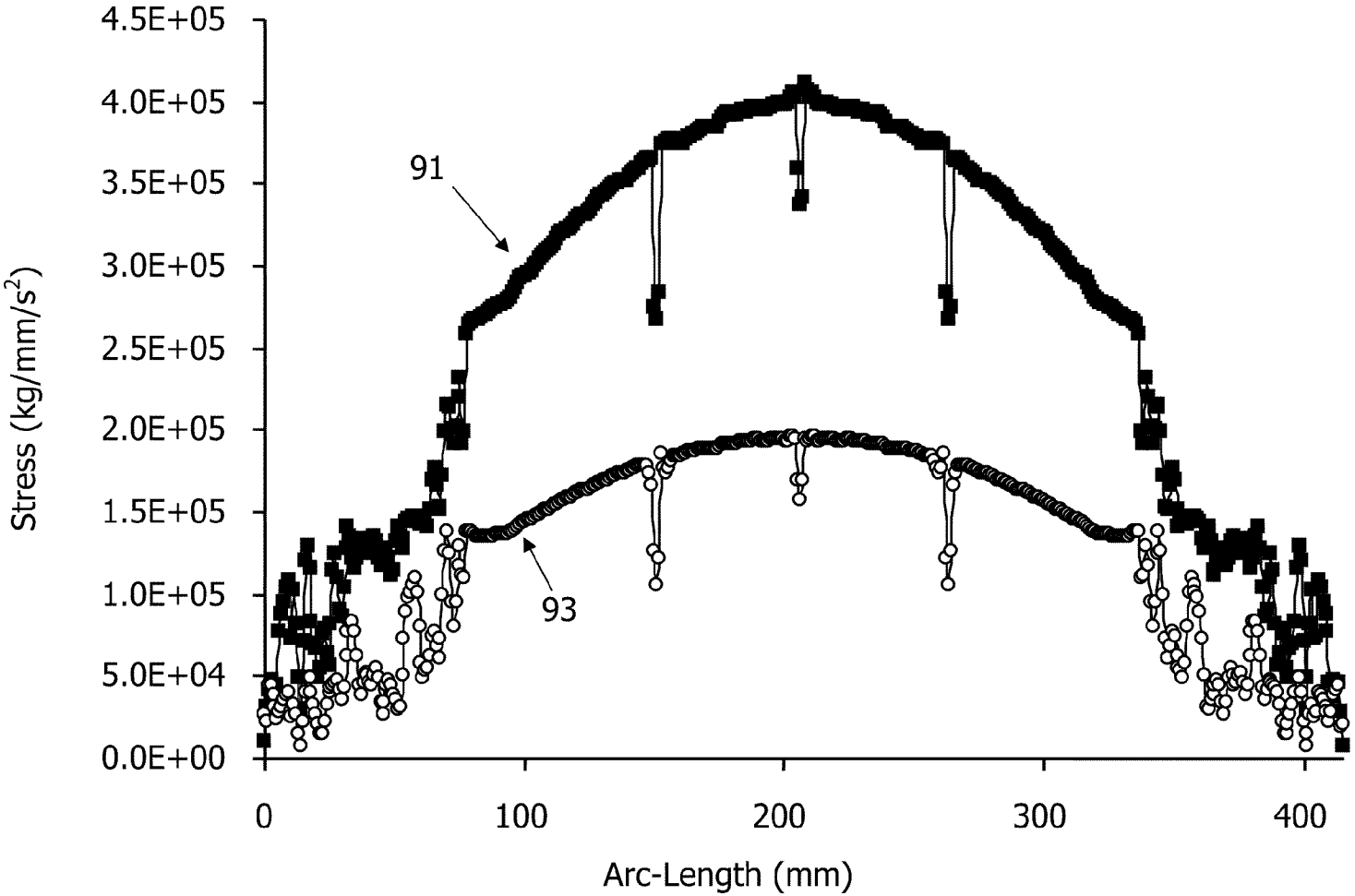
FIG. 17 is a graph similar to FIG. 16 comparing stresses in wafers resulting from lateral shift and vertical tilt of the grinding wheels.

FIG. 17 illustrates stresses 91 and 93 in wafers W when the grinding wheels shift and vertically tilt. Again, stresses 93 associated with pads 11*a* and 11*b* are generally constant along the entire periphery of the grinding wheel opening edges 39*a* and 39*b*. In addition, there is a markedly less increase in stress 93 in the wafers W held by pads 11*a* and 11*b* at locations corresponding to the wafer centers WC. Accordingly, when the grinding wheels 9*a* and 9*b* shift and vertically tilt, the wafers W do not bend as sharply adjacent the periphery of the grinding wheel openings 39*a* and 39*b* and center-mark formation is reduced.

Figure 18:
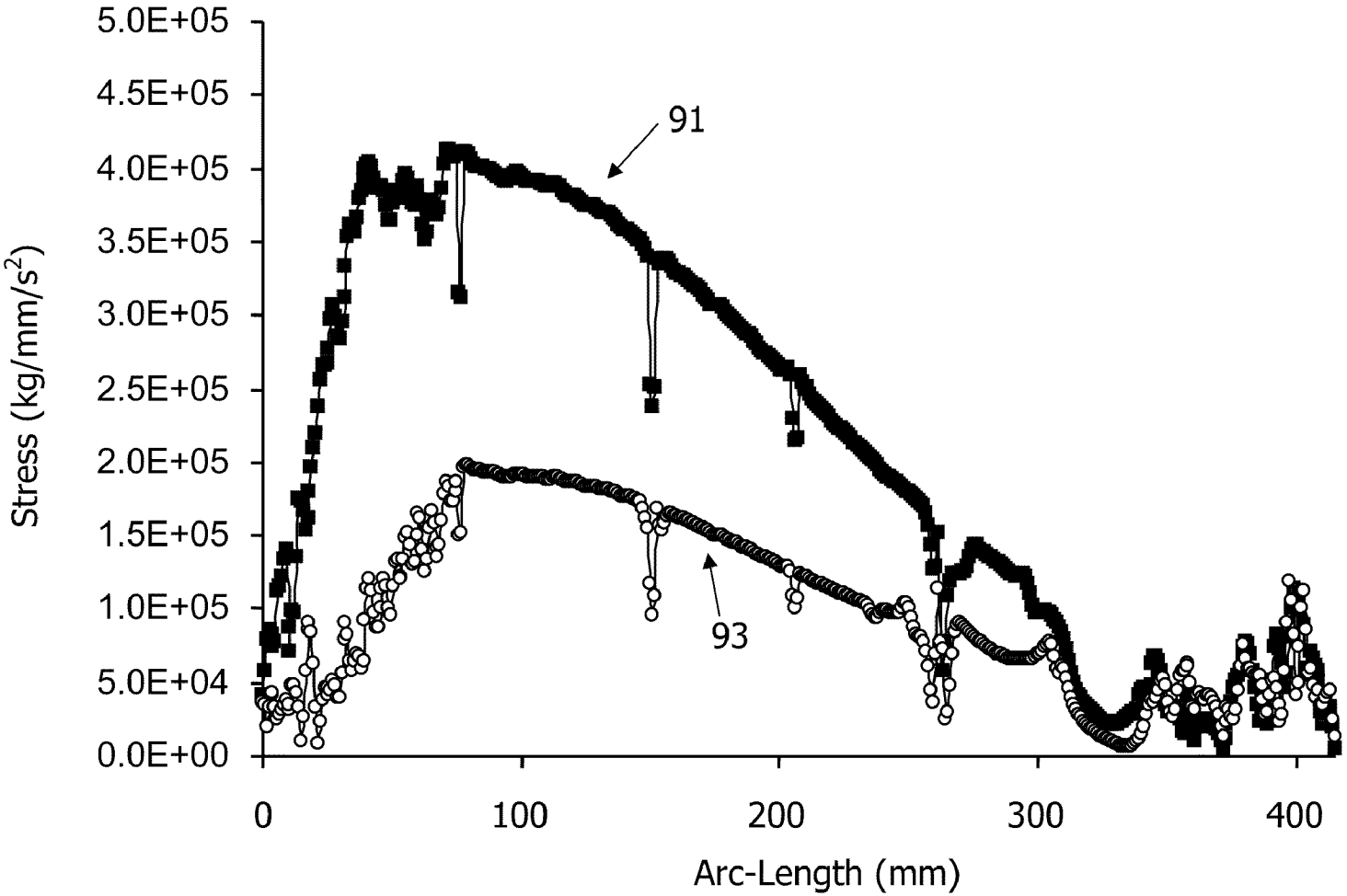
FIG. 18 is a graph similar to FIG. 16 comparing stresses in wafers resulting from lateral shift in combination with horizontal tilt of the grinding wheels.
Figure 19:
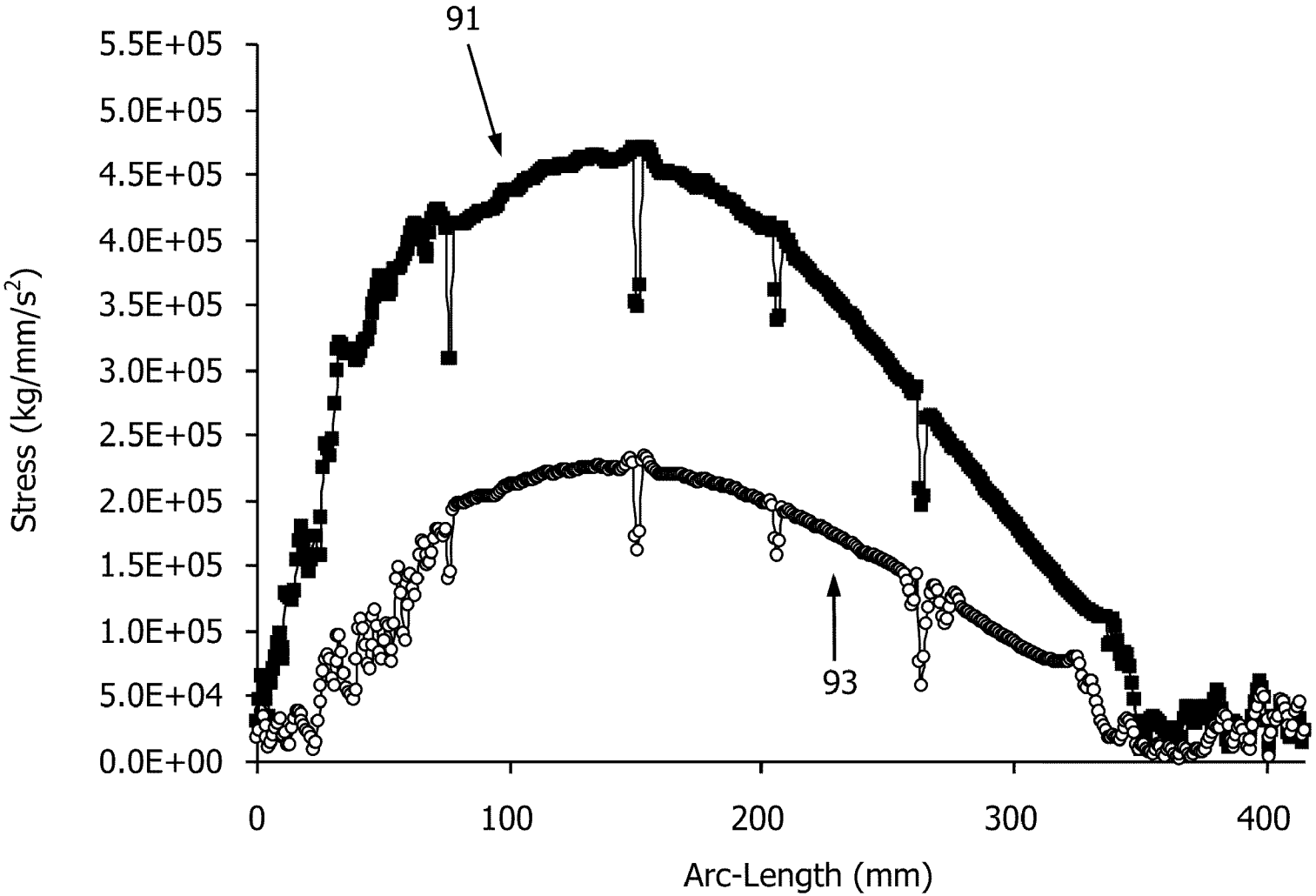
FIG. 19 is a graph similar to FIG. 16 comparing stresses in wafers resulting from the combined effect of lateral shift, vertical tilt, and horizontal tilt of the grinding wheels.

FIG. 18 illustrates stresses 91 and 93 in wafers W when the wheels shift and horizontally tilt. As can be seen, stresses 93 at the left side of the wafers W do not increase as sharply as do stresses 91. Accordingly, wafers W held by pads 11*a* and 11*b* do not bend as sharply at their peripheries when wheels 9*a* and 9*b* shift and horizontally tilt and B-ring formation is reduced. Similar results are shown in FIG. 19 when stresses 91 and 93 in wafers W are caused by the combined effect of shift, vertical tilt, and horizontal tilt of grinding wheels.

Figure 20:
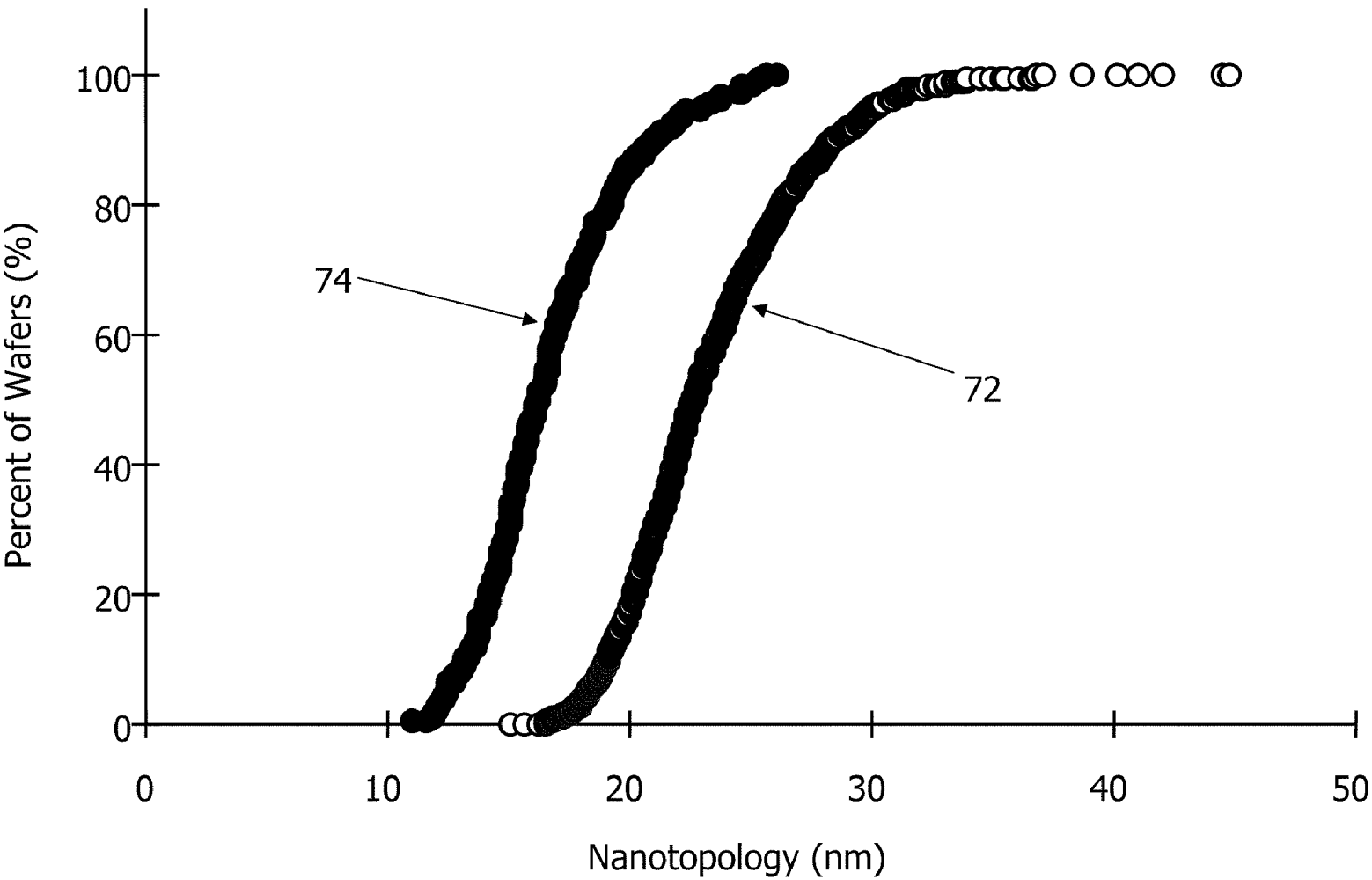
FIG. 20 is a graph comparing upper 0.05 percentile nanotopology values for wafers ground in a prior art wafer-clamping device to wafers ground in a wafer-clamping device of the invention.

FIG. 20 charts upper 0.05 percentile nanotopology values for wafers ground using hydrostatic pads 11' of the prior art and hydrostatic pads 11*a* and 11*b* of the invention. Nanotopology values for wafers ground using pads 11' are indicated generally by reference numeral 72, and values for wafers ground using pads 11*a* and 11*b* are indicated generally by reference numeral 74. The wafers ground using the pads 11*a* and 11*b* of the invention have consistently lower nanotopology values 74 than the values 72 of the prior art.

Hydrostatic pads 11*a* and 11*b* of the invention may be used to grind multiple wafers W in a set of wafers in a single operational set-up. A set of wafers may comprise, for example, at least 400 wafers. It may comprise greater than 400 wafers without departing from the scope of the invention. A single operational set-up is generally considered continual operation between manual adjustments of the grinding wheels 9*a* and 9*b*. Each ground wafer W of the set generally has improved nanotopology (e.g., reduced or eliminated center-mark and B-ring formation). In particular, they each have average peak to valley variations of less than about 12 nm. For example, the average peak to valley variations of the wafers may be about 8 nm. Average peak to valley variations represent variations over an average radial scan of each wafer W. Peak to valley variations are determined around a circumference of the wafer W at multiple radii of the wafer, and an average of those values is taken to determine the average variation.

Figure 21:
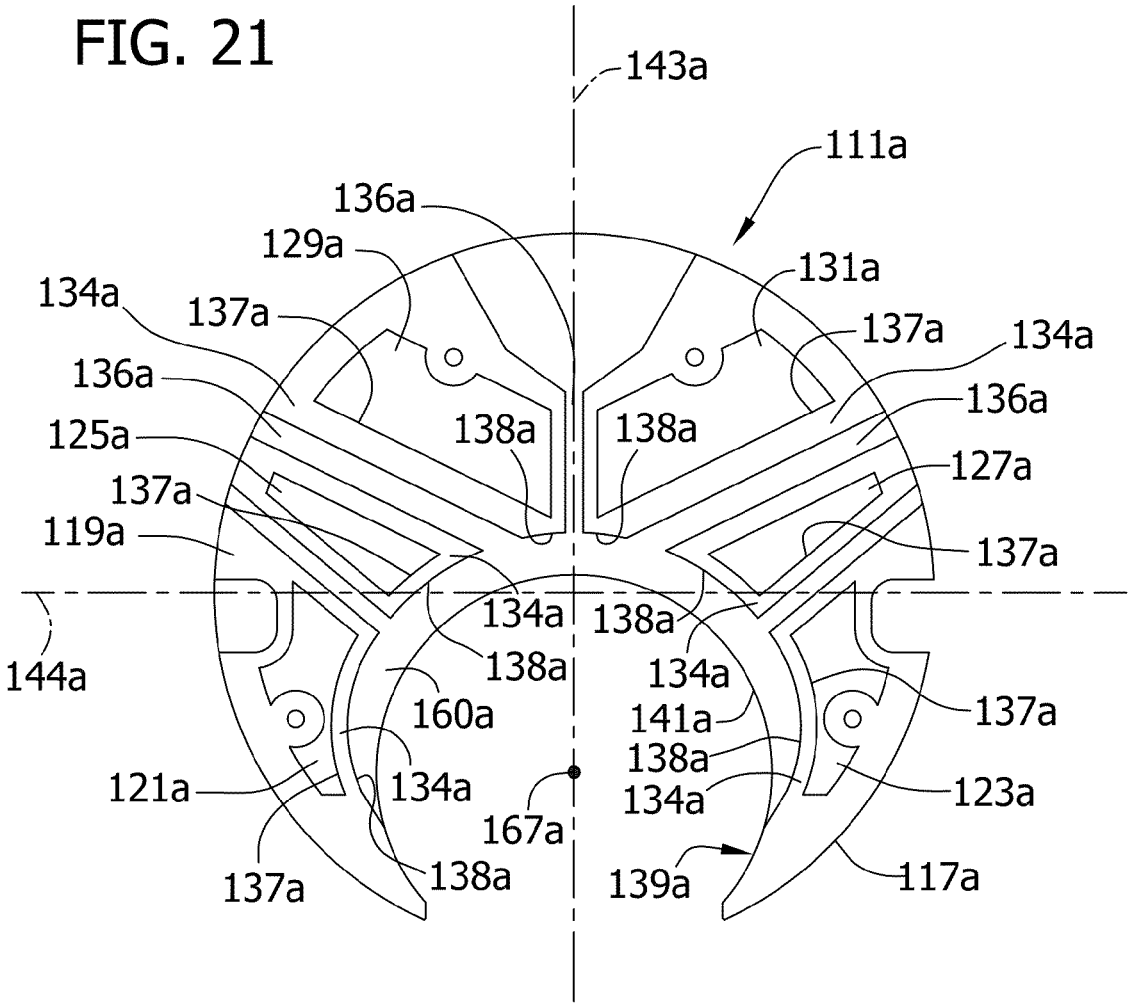
FIG. 21 is a schematic illustration of a hydrostatic pad according to a second embodiment of the invention, showing hydrostatic pocket configuration of a face of the pad opposing a semiconductor wafer during grinding.

FIG. 21 schematically illustrates a left hydrostatic pad according to a second embodiment of invention. The pad is designated generally by reference numeral 111*a*, and parts of this pad corresponding to parts of the pad 11*a* of the first embodiment are designated by the same reference numerals, plus "100". This hydrostatic pad 111*a* is substantially the same as the previously described hydrostatic pad 11*a*, but has hydrostatic pockets 121*a*, 123*a*, 125*a*, 127*a*, 129*a*, and 131*a* shaped and oriented differently than corresponding pockets 21*a*, 23*a*, 25*a*, 27*a*, 29*a*, and 31*a* in the pad 11*a*. Similar to pad 11*a*, the pockets 121*a*, 123*a*, 125*a*, 127*a*, 129*a*, and 131*a* are radially positioned about the grinding wheel opening 139*a* of the pad 111*a*, with pockets 121*a* and 123*a*, pockets 125*a* and 127*a*, and pockets 129*a* and 131*a* being similar and symmetrically located on opposite halves of the wafer side face 119*a*. Additionally, pockets 121*a* and 123*a* are elongated in a circumferential direction around the pad 111*a*. In this pad 111*a*, however, pockets 125*a*, 127*a*, 129*a*, and 131*a* are elongated radially away from the grinding wheel opening 139*a*. These pads 111*a* and 111*b* are the same as pads 11*a* and 11*b* in all other aspects.

It is additionally contemplated that a center of clamping of hydrostatic pads could be affected by controlling the pressure of the water applied to pockets of the hydrostatic pads. This would lower the center of clamping, moving it closer to a rotational axis of grinding wheels of a wafer-clamping device. More specifically, the fluid pressure in each pocket (or some subset of pockets) could be changed during the course of grinding and/or controlled independently of the other pocket(s). One way of varying the pressure among the several pockets is by making the sizes of the orifices opening into the pockets different. Moreover, the stiffness of the region associated with each pocket can be varied among the pockets by making the depth of the pockets different. Deeper pockets will result in a more compliant hold on the wafer W in the region of the deeper pocket than shallower pockets, which will hold the wafer stiffly in the region of the shallower pocket.

The hydrostatic pads 11*a*, 11*b*, 111*a*, and 111*b* illustrated and described herein have been described for use with a wafer W having a diameter of about 300 mm. As previously stated, a hydrostatic pad may be sized on a reduced scale for use to grind a 200 mm wafer without departing from the scope of the invention. This applies to each of the hydrostatic pad dimensions described herein.

The hydrostatic pads 11*a* and 11*b* of the invention are made of a suitable rigid material, such as metal, capable of supporting the wafer W during grinding operation and of withstanding repeated grinding use. Hydrostatic pads made of other, similarly rigid material do not depart from the scope of the invention.

When introducing elements of the present invention or the preferred embodiment(s) thereof, the articles "a", "an", "the" and "said" are intended to mean that there are one or more of the elements. The terms "comprising", "including" and "having" are intended to be inclusive and mean that there may be additional elements other than the listed elements.

As various changes could be made in the above without departing from the scope of the invention, it is intended that all matter contained in the above description and shown in the accompanying drawings shall be interpreted as illustrative and not in a limiting sense.

What is claimed is:

1. A method for forming a set of wafers comprising:

providing a holder having a body forming a first hydrostatic pad and a second body forming a second hydrostatic pad, the pads each having an opening for a first grinding wheel and a second grinding wheel, respectively, for engagement with the wafer, the openings having a peripheral edge defined by the body;

each body having at least one pocket and being adapted for receiving fluid through the body into the pocket for providing a barrier between the body and the wafer during grinding, and a free region recessed in each body between the peripheral edge of said opening and the pocket;

positioning the wafer between the first and second hydrostatic pads and between a first and second grinding wheel located within each opening of the pads;

holding the wafer between the hydrostatic pads and between the grinding wheels so that substantially no clamping pressure is applied to the held wafer adjacent peripheral edges of the grinding wheels, adjacent the peripheral edges of the openings in the pads and at the edge of the radially opposed pockets; and grinding the wafer to have a nanotopology of about 12 nm or less.

2. The method for forming a set of semiconductor wafers as set forth in claim 1 wherein the set comprises at least 400 consecutively produced wafers having the nanotopology and formed by the single set-up.

3. The method for forming a set of semiconductor wafers as set forth in claim 2 wherein the set comprises at least 800 wafers.

4. The method for forming a set of semiconductor wafers as set forth in claim 2 wherein each of the wafers in the set are substantially free of center-marks and B-rings.

5. The method for forming a set of semiconductor wafers as set forth in claim 2 wherein each wafer has a nanotopology with average peak to valley variations of about 8 nm or less.

6. The method for forming a set of semiconductor wafers as set forth in claim 1 wherein the set of wafers is formed from standard wafers having diameters of about 200 mm to about 300 mm.

7. The method for forming a set of semiconductor wafers as set forth in claim 1 wherein the peak to valley variations are determined around a circumference of each of the wafers.

8. The method for forming a set of semiconductor wafers as set forth in claim 1 wherein said holding the wafer comprises holding the wafer such that both surfaces of the wafer are ground at a same time.

9. The method for forming a set of semiconductor wafers as set forth in claim 1 wherein at least one of the first and second hydrostatic pads comprise at least one hydrostatic pocket.

10. The method for forming a set of semiconductor wafers as set forth in claim 9 wherein the at least one hydrostatic pocket is arcuate in shape and elongated in a circumferential direction of the at least one of the first and second hydrostatic pads.

* * * * *